US009227714B2

(12) United States Patent
Saruwatari et al.

(10) Patent No.: US 9,227,714 B2
(45) Date of Patent: Jan. 5, 2016

(54) OUTBOARD MOTOR

(71) Applicant: YAMAHA HATSUDOKI KABUSHIKI KAISHA, Iwata-shi, Shizuoka (JP)

(72) Inventors: Kimitaka Saruwatari, Shizuoka (JP); Kouichi Isozaki, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 14/531,020

(22) Filed: Nov. 3, 2014

(65) Prior Publication Data

US 2015/0133007 A1 May 14, 2015

(30) Foreign Application Priority Data

Nov. 8, 2013 (JP) ..... 2013-232396

(51) Int. Cl.

| | |
|---|---|
| ***B63H 20/28*** | (2006.01) |
| ***B63H 20/00*** | (2006.01) |
| ***F02B 61/04*** | (2006.01) |
| ***F01M 11/00*** | (2006.01) |

(52) U.S. Cl.

CPC ..... *B63H 20/28* (2013.01); *B63H 20/002* (2013.01); *F01M 11/0004* (2013.01); *F02B 61/045* (2013.01); *F01M 2011/0025* (2013.01)

(58) Field of Classification Search

CPC ..... B63H 21/10; B63H 20/00; B63H 20/24; B63H 20/28

USPC ..... 440/88 L; 123/195 P, 196 A

See application file for complete search history.

(56) References Cited

U.S. PATENT DOCUMENTS 5,954,022 A * 9/1999 Katayama ..... B63H 20/002 123/195 P 7,571,705 B2 * 8/2009 Inaba ..... F01M 11/02 123/196 A

FOREIGN PATENT DOCUMENTS

JP 2003-002295 A 1/2003

JP 2006-168701 A 6/2006

* cited by examiner

*Primary Examiner* — Lars A Olson

(74) *Attorney, Agent, or Firm* — Keating and Bennett, LLP

(57) ABSTRACT

An outboard motor includes an engine including a crankshaft that is rotatable about a rotation axis extending in an up-down direction, and a crank chamber that houses the crankshaft. The outboard motor includes an oil pan including an oil retaining portion, a cooling water passage disposed along an outer wall surface of the oil retaining portion, an oil recovery passage extending downward from the crank chamber to lead lubricating oil inside the crank chamber to the inside of the oil retaining portion, and a guide member. The guide member includes a shielding portion disposed inside the oil recovery passage so as to be located over an opening of the oil retaining portion, and a guide hole disposed inside the oil recovery passage so as to be located over an inner wall surface of the oil retaining portion. The guide member is configured to guide lubricating oil to the guide hole by the shielding portion and allow lubricating oil to flow down to the inner wall surface of the oil retaining portion from the guide hole.

10 Claims, 15 Drawing Sheets

OUTBOARD MOTOR

BACKGROUND OF THE INVENTION

1. Field of the Invention

The present invention relates to an outboard motor.

2. Description of the Related Art

An outboard motor according to a related art has been described in, for example, Japanese Patent Application Publication No. 2003-002295. The outboard motor includes an oil pan that retains lubricating oil to lubricate an engine and a water retaining portion disposed around the oil pan.

An outboard motor according to another related art has been described in, for example, Japanese Patent Application Publication No. 2006-168701. In the outboard motor, a cooling water jacket is disposed at a bottom portion of an oil pan. A space is provided between at least a portion of an outer wall surface of the oil pan and a cooling water passage.

SUMMARY OF THE INVENTION

The inventor of preferred embodiments of the present invention described and claimed in the present application conducted an extensive study and research regarding an outboard motor, such as the one described above, and in doing so, discovered and first recognized new unique challenges and previously unrecognized possibilities for improvements as described in greater detail below.

Lubricating oil for engine lubrication needs to be sufficiently cooled in an oil pan. If the cooling of lubricating oil in the oil pan is insufficient, a separate component such as an oil cooler needs to be provided.

In the outboard motor described in Japanese Patent Application Publication No. 2003-002295, because the water retaining portion is disposed around the oil pan, it is considered that an inner wall surface of the oil pan is maintained at low temperature, and lubricating oil inside the oil pan is efficiently cooled. However, when the liquid level of the lubricating oil is lower than the liquid level of cooling water, a portion that is not in contact with the lubricating oil (a portion that is in contact with air) in the inner wall surface of the oil pan is maintained at low temperature. Therefore, condensation may occur at the inner wall surface of the oil pan to degrade performance of the lubricating oil due to dilution or the like.

In the outboard motor described in Japanese Patent Application Publication No. 2006-168701, a space is provided between at least a portion of the outer wall surface of the oil pan and the cooling water passage to avoid the inner wall surface of the oil pan from being maintained at a lower temperature at a position higher than the bottom portion of the oil pan in order to prevent the occurrence of condensation. However, with this arrangement, the area of a portion that is efficiently cooled by cooling water in the inner wall surface of the oil pan decreases, so that the lubricating oil cannot be efficiently cooled inside the oil pan.

If the area of the outer wall surface of the oil retaining portion contacting cooling water is increased, the cooling performance of the lubricating oil in the oil pan can be enhanced. However, if the area to contact cooling water is large, there is a high possibility that condensation occurs. If the area to contact cooling water is reduced in order to prevent the occurrence of condensation, the cooling performance of the lubricating oil in the oil pan degrades. Thus, with the outboard motors of the related art described above, preventing the occurrence of condensation in the oil pan while enhancing the cooling performance of the lubricating oil in the oil pan cannot be achieved.

In order to overcome the previously unrecognized and unsolved challenges described above, a preferred embodiment of the present invention provides an outboard motor including an engine including a crankshaft that is rotatable about a rotation axis extending in an up-down direction, and a crank chamber that houses the crankshaft, an oil pan that includes an oil retaining portion provided at an upper end portion thereof with an opening opened upward, and that is disposed under the engine and configured to retain lubricating oil to be supplied to at least the crank chamber inside the oil retaining portion, a cooling water passage disposed along an outer wall surface of the oil retaining portion, an oil recovery passage that extends downward from the crank chamber to the oil retaining portion and configured to lead lubricating oil inside the crank chamber to the inside of the oil retaining portion, and a guide member that is provided with a shielding portion disposed inside the oil recovery passage so as to be located over the opening of the oil retaining portion and a guide hole disposed inside the oil recovery passage so as to be located over an inner wall surface of the oil retaining portion and that is configured to guide lubricating oil inside the oil recovery passage to the guide hole by the shielding portion and to allow lubricating oil to flow down to the inner wall surface of the oil retaining portion from the guide hole.

According to this arrangement, because cooling water contacts the outer wall surface of the oil retaining portion, the inner wall surface of the oil retaining portion is efficiently cooled, and maintained at low temperature. Lubricating oil is thus efficiently cooled.

Lubricating oil that flows down toward the opening of the oil retaining portion is blocked by the shielding portion, and guided to the guide hole. Because the guide hole is located over the inner wall surface of the oil retaining portion, the lubricating oil that has flowed down from the guide hole flows down along the inner wall surface of the oil retaining portion. The lubricating oil is thus efficiently cooled by the inner wall surface that has a low temperature. Further, because the area of a portion exposed from the lubricating oil in the inner wall surface of the oil retaining portion decreases, the amount of water to be generated by condensation is significantly reduced.

The inner wall surface of the oil retaining portion preferably includes an adjacent portion located on the periphery of the cooling water passage, and the guide hole preferably is disposed over the adjacent portion.

According to this arrangement, because lubricating oil that has flowed down from the guide hole thus flows down along the efficiently cooled adjacent portion, the lubricating oil is more efficiently cooled.

The adjacent portion of the oil retaining portion preferably is covered with lubricating oil that has passed through the guide hole.

According to this arrangement, the lubricating oil is more efficiently cooled. Because the area of a portion exposed from the lubricating oil in the inner wall surface of the oil retaining portion further decreases, the amount of water to be generated by condensation is significantly reduced.

The cooling water passage preferably includes a cooling water supply passage extending to the engine from a water inlet to be disposed in water and disposed along the outer wall surface of the oil retaining portion.

According to this arrangement, because low-temperature cooling water before being used for cooling the engine flows along the outer wall surface of the oil retaining portion, the lubricating oil is more efficiently cooled.

The outboard motor preferably further includes an exhaust passage extending downward from the engine through the oil pan, and at least a portion of the cooling water passage preferably is disposed between the oil retaining portion and the exhaust passage.

According to this arrangement, low-temperature cooling water before being used for cooling the engine is used to cool both the lubricating oil in the oil retaining portion and exhaust in the exhaust passage.

The guide member preferably includes an oil pan gasket that is provided with the shielding portion and the guide hole, and contacts the oil pan between the engine and the oil pan.

According to this arrangement, a simple design modification of the oil pan gasket easily realizes a function as a guide member that guides lubricating oil inside the oil recovery passage.

The outboard motor preferably further includes a blowby gas passage that is separated from the oil recovery passage and extends downward from the crank chamber to the oil retaining portion, and is configured to lead a blowby gas inside the crank chamber to the inside of the oil retaining portion.

According to this arrangement, disruption of the flow of lubricating oil inside the oil recovery passage by a blowby gas the flow direction of which inside the crank chamber is not fixed in one direction due to the effect of the motion of the piston of the engine is significantly reduced or prevented.

The outboard motor preferably further includes an exhaust passage extending downward from the engine through the oil pan, and an exhaust guide provided with a portion of the oil recovery passage, the blowby gas passage, and the exhaust passage, disposed between the engine and the oil pan.

The exhaust guide preferably further includes amount support portion on which a mount damper to be interposed between a hull and the outboard motor is disposed.

The guide member preferably includes an engine gasket disposed between the engine and oil pan, an exhaust guide disposed between the engine gasket and the oil pan, and an oil pan gasket disposed between the exhaust guide and the oil pan, and the shielding portion and the guide hole are provided in any of the engine gasket, the exhaust guide, and the oil pan gasket.

According to this arrangement, the degree of freedom of design increases.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
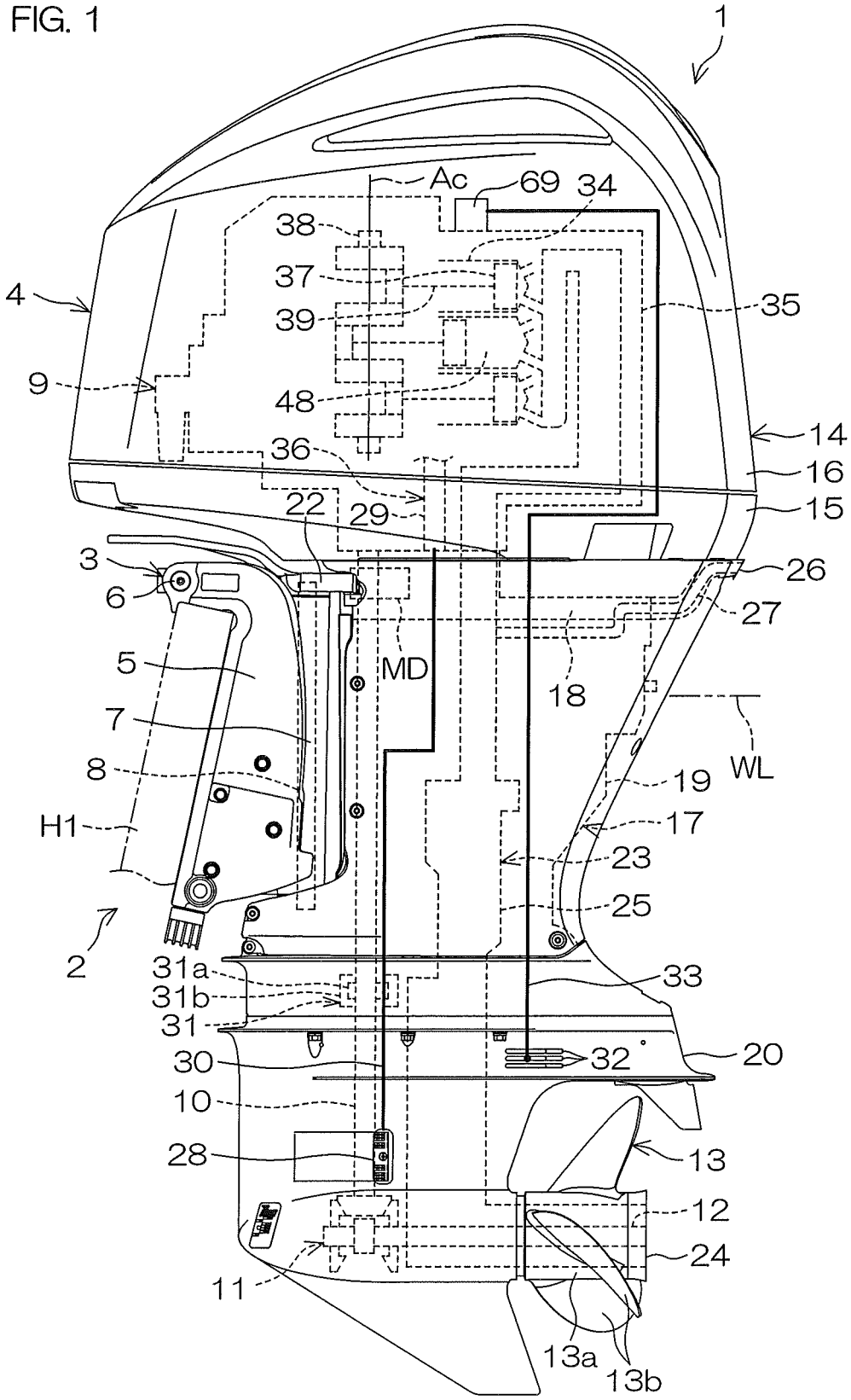
FIG. 1 is a schematic side view of an outboard motor according to a first preferred embodiment of the present invention.

FIG. 1 is a schematic side view showing a vessel 1 according to a first preferred embodiment of the present invention. As shown in FIG. 1, the vessel 1 includes a hull H1 that is configured float on a water surface and a vessel propulsion device 2 that is configured to propel the hull H1. The vessel propulsion device 2 includes a suspension device 3 that is mountable on a rear portion (stern) of the hull H1 and an outboard motor 4 coupled to the suspension device 3.

The suspension device 3 includes a pair of left and right clamp brackets 5 to be mounted on the hull H1, a tilting shaft 6 supported in a posture of extending in the left-right direction by the pair of clamp brackets 5, and a swivel bracket 7 mounted on the tilting shaft 6. The suspension device 3 further includes a steering shaft 8 supported in a posture of extending in the up-down direction by the swivel bracket 7.

The outboard motor 4 is mounted on the steering shaft 8. The steering shaft 8 is supported by the swivel bracket 7 so as to be rotatable about a steering axis (center line of the steering shaft 8) extending in the up-down direction. The swivel bracket 7 is supported by the clamp brackets 5 via the tilting shaft 6. The swivel bracket 7 is turnable about a tilt axis (center line of the tilting shaft 6) extending in the left-right direction, with respect to the clamp brackets 5. The outboard motor 4 is turnable to the left and right with respect to the suspension device 3, and is turnable up and down with respect to the suspension device 3. Thus, the outboard motor 4 is turnable to the left and right with respect to the hull H1, and is turnable up and down with respect to the hull H1.

Also, the vessel 1 preferably includes a steering bracket 22 to be mounted on the steering shaft 8 in an integrally rotatable manner, and a mount damper MD configured to function as a mount that couples the steering bracket 22 and an exhaust guide 18 to be described later of the outboard motor 4. The mount damper MD is interposed between the hull H1 and the outboard motor 4, and is configured to significantly reduce or prevent vibration of the outboard motor 4 from being transmitted to the hull H1.

The outboard motor 4 includes an engine 9 configured to generate power to rotate a propeller 13 and propel the hull 1 and a power transmission system configured to transmit the power of the engine 9 to the propeller 13. The power transmission system includes a drive shaft 10 coupled to the engine 9, a forward/reverse switching mechanism 11 coupled to the drive shaft 10, and a propeller shaft 12 coupled to the forward/reverse switching mechanism 11. The outboard motor 4 further includes an engine cover 14 that covers the engine 9 and a casing 17 that houses the power transmission system.

The engine cover 14 houses the engine 9. The engine cover 14 includes a cup-shaped bottom cover 15 opened upward, and a cup-shaped top cover 16 opened downward. The top cover 16 is removably mounted on the bottom cover 15. The opening portion of the top cover 16 is laid on the opening portion of the bottom cover 15 via a seal (not shown) one on the top of the other. The bottom cover 15 is mounted on the casing 17 (specifically, an exhaust guide 18 to be described later).

The casing 17 includes an exhaust guide 18 disposed under the engine 9, an upper case 19 disposed under the exhaust guide 18, and a lower case 20 disposed under the upper case 19. The engine 9 is mounted on the exhaust guide 18. The engine 9 is disposed higher than the steering shaft 8. The exhaust guide 18 defining and serving as an engine support member supports the engine 9 with a rotation axis of the engine 9 (corresponding to a rotation axis Ac of a crankshaft 38) being in a vertical posture.

The engine 9 is disposed over the drive shaft 10. The drive shaft 10 extends in the up-down direction inside the casing 17. A center line of the drive shaft 10 preferably is disposed on the rotation axis of the engine 9, and preferably is deviated with the rotation axis of the engine 9. An upper end portion of the drive shaft 10 is coupled to the engine 9. A lower end portion of the drive shaft 10 is coupled to a front end portion of the propeller shaft 12 via the forward/reverse switching mechanism 11. The propeller shaft 12 extends in the front-rear direction inside the casing 17. A rear end portion of the propeller shaft 12 projects rearward from the casing 17. The propeller 13 is removably mounted on the rear end portion of the propeller shaft 12. The propeller 13 includes an outer cylinder 13*a* surrounding the propeller shaft 12 about a propeller axis (center line of the propeller shaft 12), and a plurality of blades 13*b* extending outward from the outer cylinder 13*a*. The outer cylinder 13*a* and the blades 13*b* rotate about the propeller axis together with the propeller shaft 12.

The engine 9 preferably is an internal combustion engine. The engine 9 rotates in a fixed rotation direction. The rotation of the engine 9 is transmitted to the propeller 13 by the power transmission system (the drive shaft 10, the forward/reverse switching mechanism 11, and the propeller shaft 12). The propeller 13 is thus caused to rotate together with the propeller shaft 12 and a thrust that propels the vessel 1 forward or in reverse is generated. Also, the direction of a rotation transmitted from the drive shaft 10 up to the propeller shaft 12 is switched by the forward/reverse switching mechanism 11. The rotation direction of the propeller 13 and the propeller shaft 12 is thus switched between a normal rotation direction (clockwise direction when the propeller 13 is viewed from the rear) and a reverse rotation direction (direction of rotation opposite to the normal rotation direction). The direction of thrust is thus switched.

The outboard motor 4 includes an exhaust passage 23 that discharges exhaust generated by the engine 9 to the outside of the outboard motor 4. The exhaust passage 23 is provided in the interior of the outboard motor 4. The exhaust passage 23 includes an exhaust port 24 opening at a rear end portion of the propeller 13 (a rear end portion of the outer cylinder 13*a*), and a main exhaust passage 25 extending from a combustion chamber 48 of the engine 9 to the exhaust port 24. The exhaust passage 23 further includes an idle exhaust port 26 opening at an outer surface of the outboard motor 4, and an idle exhaust passage 27 extending from the main exhaust passage 25 to the idle exhaust port 26.

The main exhaust passage 25 extends downward from the engine 9 to the propeller shaft 12 via the exhaust guide 18, and extends rearward along the propeller shaft 12. The main exhaust passage 25 opens rearward at the rear end portion of the propeller 13. The exhaust port 24 is thus disposed in water. The idle exhaust port 26 and the idle exhaust passage 27 are disposed higher than the exhaust port 24. The idle exhaust passage 27 branches from the main exhaust passage 25. The idle exhaust port 26 is disposed higher than a waterline WL (height of the water surface when the vessel 1 equipped with the vessel propulsion device 2 is stopped). The idle exhaust port 26 thus opens into air.

The exhaust generated in the combustion chamber 48 is discharged into the main exhaust passage 25, and is guided toward the exhaust port 24. When the output of the engine 9 is high, the exhaust inside the main exhaust passage 25 is mainly discharged into water from the exhaust port 24. Also, a portion of the exhaust inside the main exhaust passage 25 is led to the idle exhaust port 26 by the idle exhaust passage 27, and is released into the atmosphere from the idle exhaust port 26. On the other hand, when the output of the engine 9 is low (for example, when the engine 9 is idling), the exhaust pressure inside the main exhaust passage 25 is low and the exhaust inside the main exhaust passage 25 is thus mainly released into the atmosphere from the idle exhaust port 26.

The outboard motor 4 preferably includes a water-cooled type cooling device 36 that cools the interior of the outboard motor 4. The cooling device 36 includes a water inlet 28 disposed under the engine 9 and opening at the outer surface of the outboard motor 4, and a cooling water passage 29 (water jacket) provided in the engine 9. The cooling device 36 further includes a cooling water supply passage 30 defining and serving as a cooling water passage extending from the water inlet 28 to the engine 9 to connect to the cooling water passage 29 inside the engine 9, and a water pump 31 disposed in the cooling water supply passage 30. The water pump 31 takes water outside the outboard motor 4 defining and serving as cooling water into the interior of the outboard motor 4 from the water inlet 28, and supplies the taken-in water to the engine 9 via the cooling water supply passage 30. The cooling device 36 further includes a water outlet 32 opening at an outer surface of the lower case 20, and a cooling water drain passage 33 through which water supplied from the cooling water supply passage 30 to the engine 9 flows. The cooling water drain passage 33 extends inside the outboard motor 4 from the cooling water passage 29 to the water outlet 32.

The water inlet 28 is disposed lower than the cooling water passage 29 and the water pump 31. The water inlet 28 opens at the outer surface of the lower case 20. The water inlet 28 is thus disposed in water. The water inlet 28 is connected to the cooling water passage 29 inside the engine 9 via the cooling water supply passage 30 defining and serving as a cooling water passage provided in the interior of the outboard motor 4. The water pump 31 is disposed in the cooling water supply passage 30. The water pump 31 is thus disposed in the interior of the outboard motor 4. The water pump 31 is disposed lower than the engine 9.

The water pump 31 is mounted on the drive shaft 10. The water pump 31 is a rotary pump including an impeller 31*a* defining and serving as a rotor that rotates together with the drive shaft 10, and a pump case 31*b* that houses the impeller 31*a*. When the engine 9 rotates the drive shaft 10, the impeller 31*a* rotates inside the pump case 31*b* and a suction force to suck water outside the outboard motor 4 into the water inlet 28 is generated. The water pump 31 is thus driven by the engine 9. The impeller 31*a* defining and serving as a rotor is driven to rotate by the engine 9 such that the flow rate of water increases with an increase in the rotation speed of the engine 9.

The water outside the outboard motor 4 defining and serving as cooling water is sucked from the water inlet 28 into the cooling water supply passage 30 defining and serving as a cooling water passage, and is delivered from the cooling water supply passage 30 to the cooling water passage 29 (water jacket) inside the engine 9 via the water pump 31. High-temperature portions of the engine 9 etc., are thus cooled by the cooling water. Then, the cooling water supplied to the engine 9 is guided by the cooling water drain passage 33 to the water outlet 32, and is discharged from the water outlet 32.

The engine 9 includes an engine main body 35 provided with a plurality of cylinders 34. The engine 9 may be an in-line engine or a V-type engine, or may be an engine of a type other than these, for example. Also, the engine 9 is not limited to being a multi-cylinder engine and may instead be a single-cylinder engine, for example. The engine main body 35 includes a plurality of pistons 37 respectively disposed inside the plurality of cylinders 34, a crankshaft 38 that is rotatable about the rotation axis Ac extending in the up-down direction, and a plurality of connecting rods 39 that couple each of the plurality of pistons 37 to the crankshaft 38.

Figure 2:
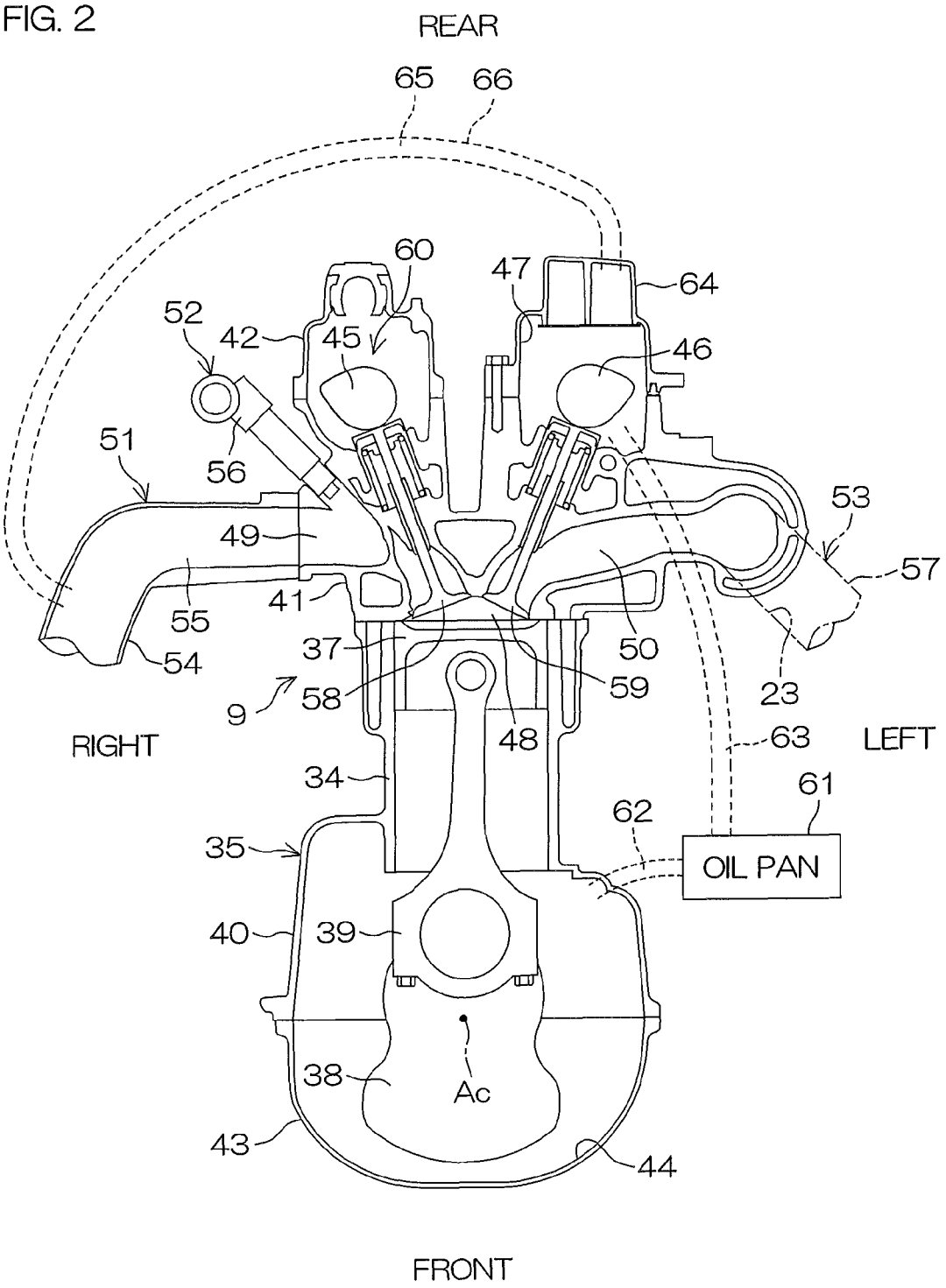
FIG. 2 is a schematic sectional view of an engine.

FIG. 2 is a schematic view showing a schematic configuration of the engine 9 in FIG. 1. As shown in FIG. 2, the engine main body 35 further includes a cylinder body 40 that houses the plurality of pistons 27, a cylinder head 41 that defines the plurality of cylinders 34 together with the cylinder body 40, a head cover 42 that covers the cylinder head 41, and a crank case 43 that houses the crankshaft 38 together with the cylinder body 40.

The crank case 43, the cylinder body 40, the cylinder head 41, and the head cover 42 are aligned in the front-rear direction in this order from the front. The cylinder head 41 and the crack case 43 are mounted on the cylinder body 40, and are disposed on mutually opposite sides with respect to the cylinder body 40. The head cover 42 is mounted on the cylinder head 41. The crank case 43 and the cylinder body 40 define a crank chamber 44 to house the crankshaft 38 between the crank case 43 and the cylinder body 40. The cylinder head 41 and the head cover 42 define a cam chamber 47 to house an intake camshaft 45 and an exhaust cam shaft 46 between the cylinder head 41 and the head cover 42.

The engine main body 35 includes pluralities of combustion chambers 48, intake ports 49, and exhaust ports 50 provided in the cylinder head 41. Each intake port 49 and each exhaust port 50 opens at an outer surface of the cylinder head 41, and extends from the outer surface of the cylinder head 41 up to the inner surface of a corresponding combustion chamber 48.

The engine 9 includes an intake device 51 configured to supply air to the plurality of combustion chambers 48, a fuel supply device 52 that supplies fuel to the plurality of combustion chambers 48, and an exhaust device 53 that discharges exhaust generated in the plurality of combustion chambers 48 via the plurality of exhaust ports 50. The intake device 51, the fuel supply device 52, and the exhaust device 53 are mounted on the engine main body 35.

The intake device 51 includes an intake pipe 54 configured to supply air to the plurality of combustion chambers 48 via the plurality of intake ports 49. The intake pipe 54 is mounted to the cylinder head 41, and the interior of the intake pipe 54 is connected to each intake port 49. The intake ports 49 and the intake pipe 54 define a portion of an intake passage 55 that guides air to the combustion chambers 48.

The fuel supply device 52 includes a plurality of fuel injectors 56 configured to supply fuel to the plurality of combustion chambers 48. An outlet of the fuel injector 56 that injects fuel is disposed in the intake port 49.

The exhaust device 53 includes an exhaust pipe 57 configured to guide exhaust discharged from the plurality of combustion chambers 48 via the plurality of exhaust ports 50. The exhaust pipe 57 is mounted to the cylinder head 41. The cylinder body 40, the cylinder head 41, and the exhaust pipe 57 define a portion of the exhaust passage 23.

The engine 9 includes a plurality of intake valves 58 configured to open and close the plurality of intake ports 49, a plurality of exhaust valves 59 configured to open and close the plurality of exhaust ports 50, and a valve device 60 configured to move the plurality of intake valves 58 and the plurality of exhaust valves 59 to open and close corresponding intake ports 49 and corresponding exhaust ports 50. The valve device 60 includes the intake cam shaft 45, the exhaust cam shaft 46, and a cam drive device (not shown) that transmits a rotation of the crankshaft 38 to the intake cam shaft 45 and the exhaust cam shaft 46.

The outboard motor 4 includes an oil pan 61 configured to retain lubricating oil to be supplied to the engine 9. In FIG. 2, the oil pan 61 is schematically shown. In actuality, the oil pan 61 is disposed under the engine 9. More specifically, the oil pan 61 is disposed under the cylinder body 40 and the crank case 43 (deep side of the sheet in FIG. 2). The outboard motor 4 includes a first blowby gas passage 62 configured to lead a blowby gas having flowed in the interior of the crank chamber 44 (a gas that has leaked out of the combustion chamber 48 through a gap between the cylinder 34 and the piston 37) to the oil pan 61, and a second blowby gas passage 63 configured to lead a blowby gas from the oil pan 61 to the cam chamber 47.

The outboard motor 4 further includes a gas-liquid separator (oil separator) 64 that separates a liquid component from a blowby gas flowed in the cam chamber 47, and a third blowby gas passage 65 configured to lead a blowby gas from the gas-liquid separator 64 to the intake device 51. The gas-liquid separator 64 is defined by a portion of the head cover 42. The interior of the gas-liquid separator 64 is connected to the interior of the cam chamber 47 so that a fluid can move in and out of the interior of the gas-liquid separator 64 and the interior of the cam chamber 47. The third blowby gas passage 65 extends from the head cover 42 to the intake pipe 54. A portion of the third blowby gas passage 65 is defined by a blowby hose 66.

Figure 3:
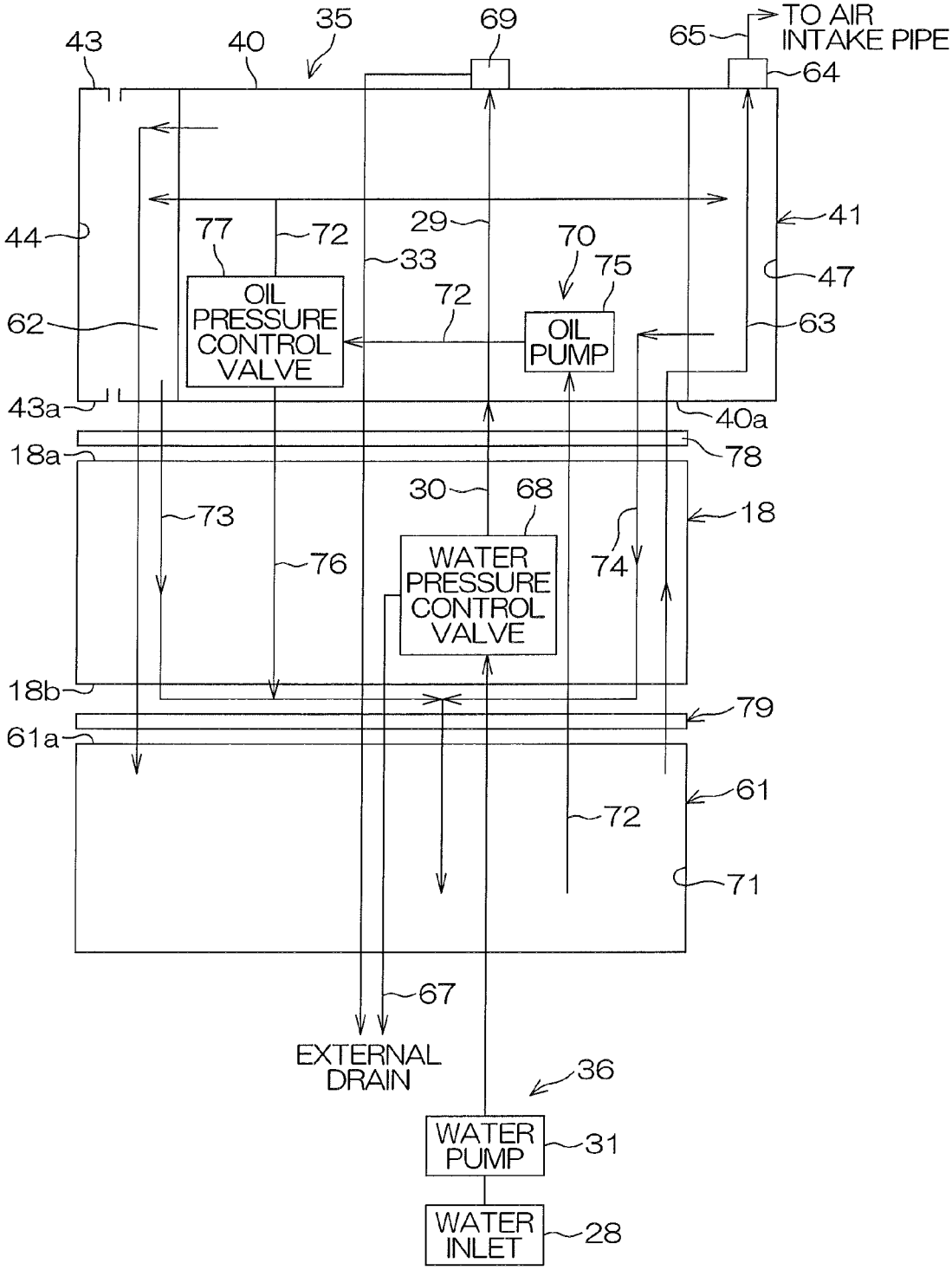
FIG. 3 is a block diagram schematically showing flows of cooling water, lubricating oil, and blowby gas.

FIG. 3 is a block diagram schematically showing an example of flows of cooling water, lubricating oil, and a blowby gas. As shown in FIG. 3, the first blowby gas passage 62 extends downward from the crank chamber 44 to an oil retaining portion 71. That is, the first blowby gas passage 62 extends from the cylinder body 40 to the oil pan 61 by way of the exhaust guide 18. The second blowby gas passage 63 extends from the oil pan 61 to the cylinder head 41 by way of the exhaust guide 18 and the cylinder body 40.

As shown in FIG. 3, the cooling device 36 includes a cooling water relief passage 67 branching from the cooling water supply passage 30 at a branch position between the engine 9 and the water pump 31, and a water pressure control valve 68 defining and serving as a pressure control valve disposed at the branch position. The water pressure control valve 68 (pressure control valve) is configured to drain a portion of the water inside the cooling water supply passage 30 to the exterior via the cooling water relief passage 67 when the water pressure inside the cooling water supply passage 30 is a set pressure or more to maintain the water pressure inside the cooling water supply passage 30 to be less than the set pressure.

The cooling device 36 further includes a thermostat 69 configured to open and close the cooling water passage 29 according to the temperature of the cooling water inside the cooling water passage 29. The thermostat 69 is disposed on, for example, the cylinder body 40. When the cooling water passage 29 is opened by the thermostat 69, the water inside the cooling water passage 29 is discharged to the exterior via the cooling water discharge passage 33 that extends from the engine 9 to the oil pan 61 downstream of the thermostat 69. A portion of the cooling water discharge passage 33 is defined in the exhaust guide 18 and the oil pan 61.

As shown in FIG. 3, the outboard motor 4 includes a lubricating device 70. The lubricating device 70 includes the oil pan 61 including an oil retaining portion 71 configured to retain lubricating oil to be supplied to at least the crank chamber 44, and disposed under the engine 9. The lubricating device 70 further includes an oil supply passage 72 configured to lead lubricating oil in the oil retaining portion 71 to at least the crank chamber 44 of the engine 9. In the present first preferred embodiment, description will be given in line with the example in which lubricating oil is led to the crank chamber 44 and the cam chamber 47 shown in FIG. 3.

The lubricating device 70 further includes a first oil recovery passage 73 that extends downward from the crank chamber 44 to the oil retaining portion 71 and is configured to lead lubricating oil inside the crank chamber 44 to the oil retaining portion 71 of the oil pan 61. The lubricating device 70 further includes a second oil recovery passage 74 that is configured to return lubricating oil used for lubrication inside the cam chamber 47 to the oil retaining portion 71 of the oil pan 61. The first blowby gas passage 62 is defined separately from the first oil recovery passage 73.

The lubricating device 70 further includes an oil pump 75 disposed in a halfway portion of the oil supply passage 72 and to be driven by the engine 9, a third oil recovery passage 76 branching from a branch position disposed downstream of the oil pump 75 in the oil supply passage 72, and an oil pressure control valve 77 disposed at the branch position.

The oil pressure control valve 77 defines and serves as a relief function of returning a portion of the lubricating oil in the oil supply passage 72 to the oil retaining portion 71 of the oil pan 61 via the third oil recovery passage 76 when the pressure of the lubricating oil has reached a set pressure or more. The pressure of the lubricating oil inside the oil supply passage 72 is thus maintained to be less than the set pressure.

The outboard motor 4 includes an engine gasket 78 and an oil pan gasket 79. The engine gasket 78 is disposed between the engine 9 and the oil pan 61. The exhaust guide 18 is disposed between the engine gasket 78 and the oil pan 61. The oil pan gasket 79 is disposed between the exhaust guide 18 and the oil pan 61. In the respective gaskets 78 and 79, holes (which are not shown in FIG. 3 being a schematic view) through which corresponding oil, cooling water, and blowby gas are passed are respectively defined.

Figure 4:
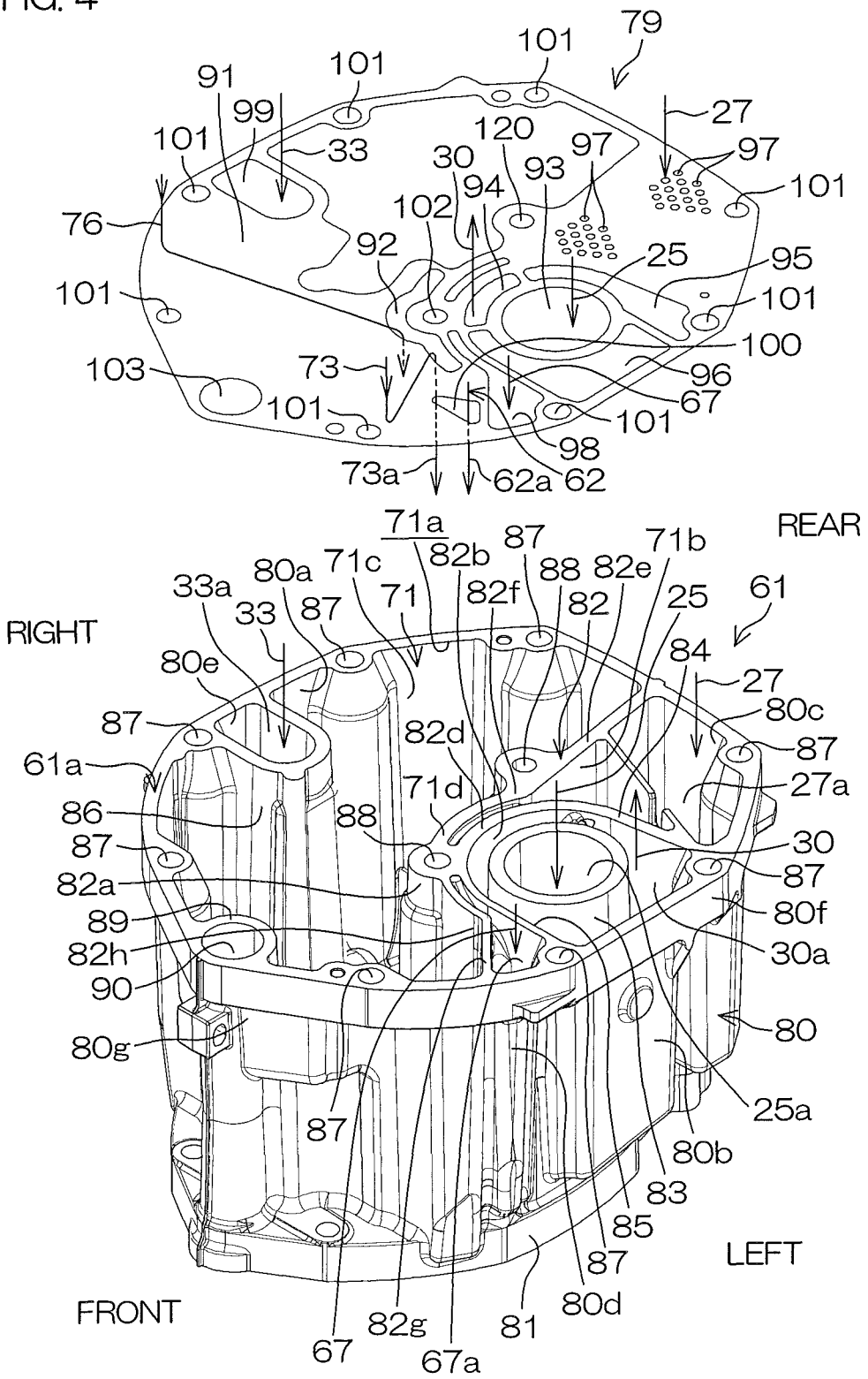
FIG. 4 is an exploded perspective view of an oil pan and an oil pan gasket.
Figure 5:
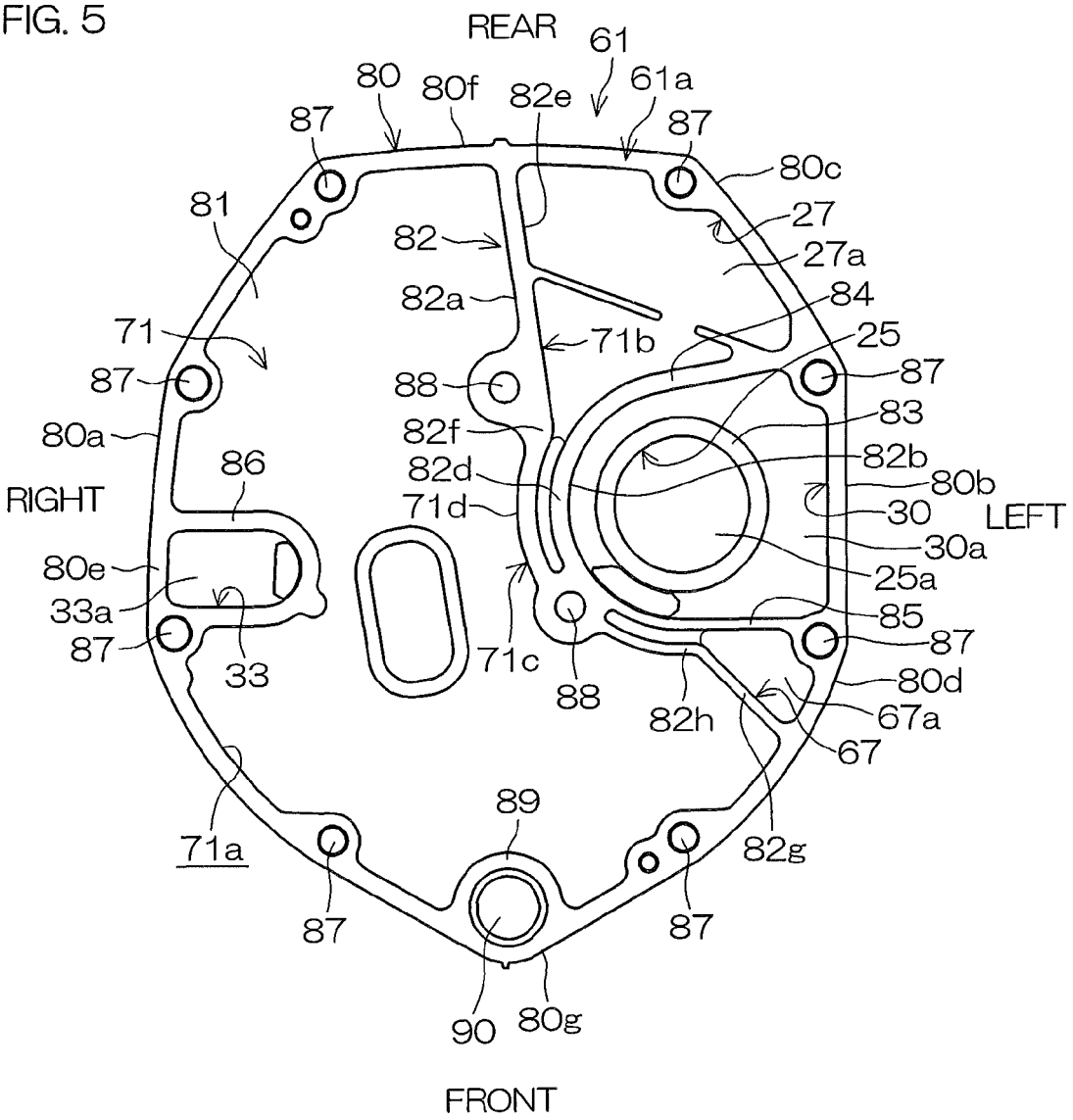
FIG. 5 is a plan view of the oil pan.

FIG. 4 is an exploded perspective view of an oil pan gasket and an oil pan, and FIG. 5 is a plan view of the oil pan. As shown in FIG. 4 and FIG. 5, the oil pan 61 includes the oil retaining portion 71 located at an upper end portion thereof with an opening 71*a* opened upward. The upper end portion of the oil retaining portion 71 corresponds to an upper end portion 61*a* of the oil pan 61. The oil retaining portion 71 is configured to retain lubricating oil to be supplied to at least the crank chamber 44. The oil retaining portion 71 includes an outer wall surface 71*b* and an inner wall surface 71*c*.

The oil pan 61 includes a peripheral side wall 80 extending in the up-down direction, a bottom wall 81 coupled to a lower end portion of the peripheral side wall 80, and a first partition wall 82 that defines the oil retaining portion 71 together with a portion 80*a* being a portion of the peripheral side wall 80 and a portion of the bottom wall 81. A lower end portion of the first partition wall 82 is coupled to the bottom wall 81. The first partition wall 82 includes a portion that defines a portion of the outer wall surface 71*b* of the oil retaining portion 71, and a portion that defines a portion of the inner wall surface 71*c* of the oil retaining portion 71.

As shown in FIG. 4 and FIG. 5, the oil pan 61 includes a portion 25*a* being a portion of the main exhaust passage 25 extending downward from the engine 9. That is, the outboard motor 4 includes an exhaust passage extending downward from the engine 9 through the oil pan 61. The portion 25*a* of the main exhaust passage 25 is defined by being demarcated by a cylindrical second partition wall 83 extending up and down from the bottom wall 81 of the oil pan 61.

As shown in FIG. 4 and FIG. 5, the oil pan 61 includes a cooling water passage disposed along the outer wall surface 71*b* of the oil retaining portion 71. Specifically, the oil pan 61 defines the cooling water supply passage 30 defining and serving as a cooling water passage disposed along the outer wall surface 71*b* of the oil retaining portion 71. The inner wall surface 71*c* of the oil retaining portion 71 includes an adjacent portion 71*d* that is adjacent along the periphery of the cooling water supply passage 30 defining and serving as a cooling water passage. Specifically, as shown in FIG. 5, the adjacent portion 71*d* of the inner wall surface 71*c* of the oil retaining portion 71 is disposed in an inner wall surface 82*a* of the first partition wall 82, which constitutes a portion of the inner wall surface of the oil retaining portion 71. The cooling water supply passage 30 is disposed around the portion 25*a* being a portion of the main exhaust passage 25 defining and serving as an exhaust passage. A portion of the cooling water passage is disposed between the oil retaining portion 71 and the exhaust passage. Specifically, at least a portion of the cooling water supply passage 30 (corresponding to a portion 30*a* of the cooling water supply passage 30) is disposed between the oil retaining portion 71 and the main exhaust passage 25.

As shown in FIG. 4 and FIG. 5, the oil pan 61 includes a third partition wall 84 and a fourth partition wall 85 that respectively couple a portion 82*d* that defines the adjacent portion 71*d* in the first partition wall 82 and a portion 80*b* of the peripheral side wall 80. Lower end portions of the third partition wall 84 and the fourth partition wall 85 are coupled to the bottom wall 81. The portion 82*d* that defines the adjacent portion 71*d* in the first partition wall 82, the third partition wall 84, the fourth partition wall 85, and the portion 80*b* of the peripheral side wall 80 are continuous so as to surround the periphery of the second partition wall 83.

The portion 30*a* of the cooling water supply passage 30 is defined between a continuous body including the portion 82*d* of the first partition wall 82, the third partition wall 84, the fourth partition wall 85, and the portion 80*b* of the peripheral side wall 80 and the second partition wall 83 surrounded by the continuous body. The portion 82*d* that defines the adjacent portion 71*d* in the first partition wall 82 is a partition between the portion 30*a* of the cooling water supply passage 30 and the oil retaining portion 71. The second partition wall 83 is a partition between the portion 30*a* of the cooling water supply passage 30 and the portion 25*a* of the main exhaust passage 25.

The oil pan 61 includes a portion 27*a* being a portion of the idle exhaust passage 27. The portion 27*a* of the idle exhaust passage 27 is defined by being surrounded by a portion 82*e* of the first partition wall 82, the third partition wall 84, and a portion 80*c* of the peripheral side wall 80. The portion 82*e* of the first partition wall 82 connects one end 82*h* of the portion 82*d* that defines the adjacent portion 71*d* and the portion 80*c* of the peripheral side wall 80. The portion 82*e* of the first partition wall 82 is a partition between the portion 27*a* of the idle exhaust passage 27 and the oil retaining portion 71. The third partition wall 84 is a partition between the portion 27*a* of the idle exhaust passage 27 and the portion 30*a* of the cooling water supply passage 30.

The oil pan 61 further includes a portion 67*a* being a portion of the cooling water relief passage 67. The portion 67*a* of the cooling water relief passage 67 is defined by being surrounded by a portion 82*g* of the first partition wall 82, the fourth partition wall 85, and the portion 80*d* of the peripheral side wall 80. The portion 82*g* of the first partition wall 82 connects the other end 82*h* of the portion 82*d* that defines the adjacent portion 71*d* and a portion 80*d* of the peripheral side wall 80. The fourth partition wall 85 is a partition between the portion 30*a* of the cooling water supply passage 30 and the portion 67*a* of the cooling water relief passage 67. The portion 82*g* of the first partition wall 82 is a partition between the portion 67*a* of the cooling water relief passage 67 and the oil retaining portion 71.

The oil pan 61 further includes a portion 33*a* being a portion of the cooling water discharge passage 33. The oil pan 61 includes a fifth partition wall 86 that projects in an arch shape from a portion 80*e* of the peripheral side wall 80 to the oil retaining portion 71 side. The portion 33*a* of the cooling water discharge passage 33 is defined by being surrounded by the portion 80*e* of the peripheral side wall 80 and the fifth partition wall 86. The fifth partition wall 86 is a partition between the portion 33*a* of the cooling water discharge passage 33 and the oil retaining portion 71.

The oil pan 61 further includes an annular flange 80*f* that is provided at an upper end portion of the peripheral side wall 80 and projects toward the outer lateral side. The flange 80*f* defines a plurality of screw insertion holes 87 extending in the up-down direction and spaced at intervals therebetween. Also, the first partition wall 82 defines a screw hole 88 extending in the up-down direction and opened upward. The oil pan 61 further includes a steering shaft insertion hole 90 which penetrates through the oil pan 61 in the up-down direction and through which the steering shaft 8 is inserted. The oil pan 61 includes a sixth partition wall 89 that projects in an arch shape from a portion 80*g* of the peripheral side wall 80 to the oil retaining portion 71 side, and extends up and down. The steering shaft insertion hole 90 is defined by being surrounded by the portion 80*g* of the peripheral side wall 80 and the sixth partition wall 89.

Figure 6:
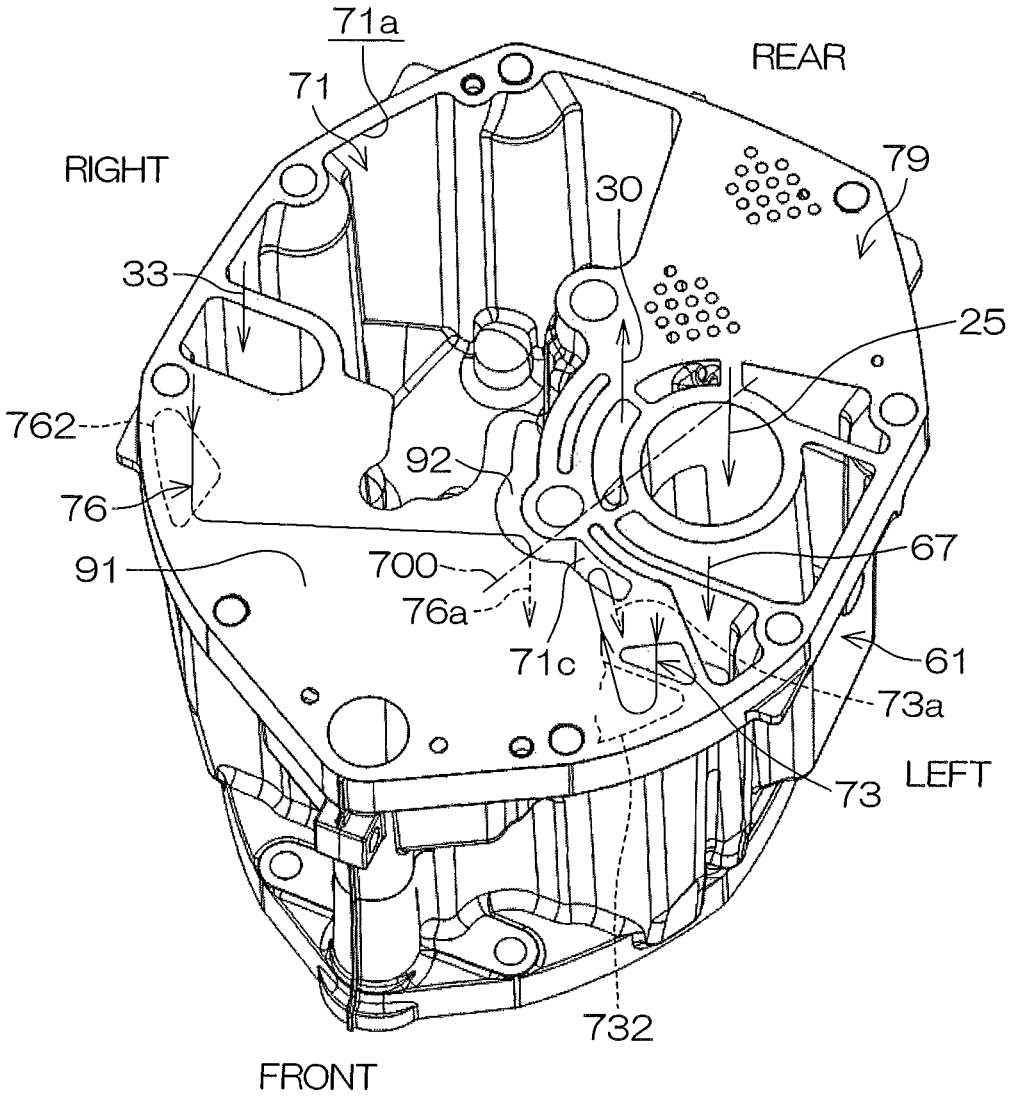
FIG. 6 is a perspective view of the oil pan fitted with the oil pan gasket.
Figure 7:
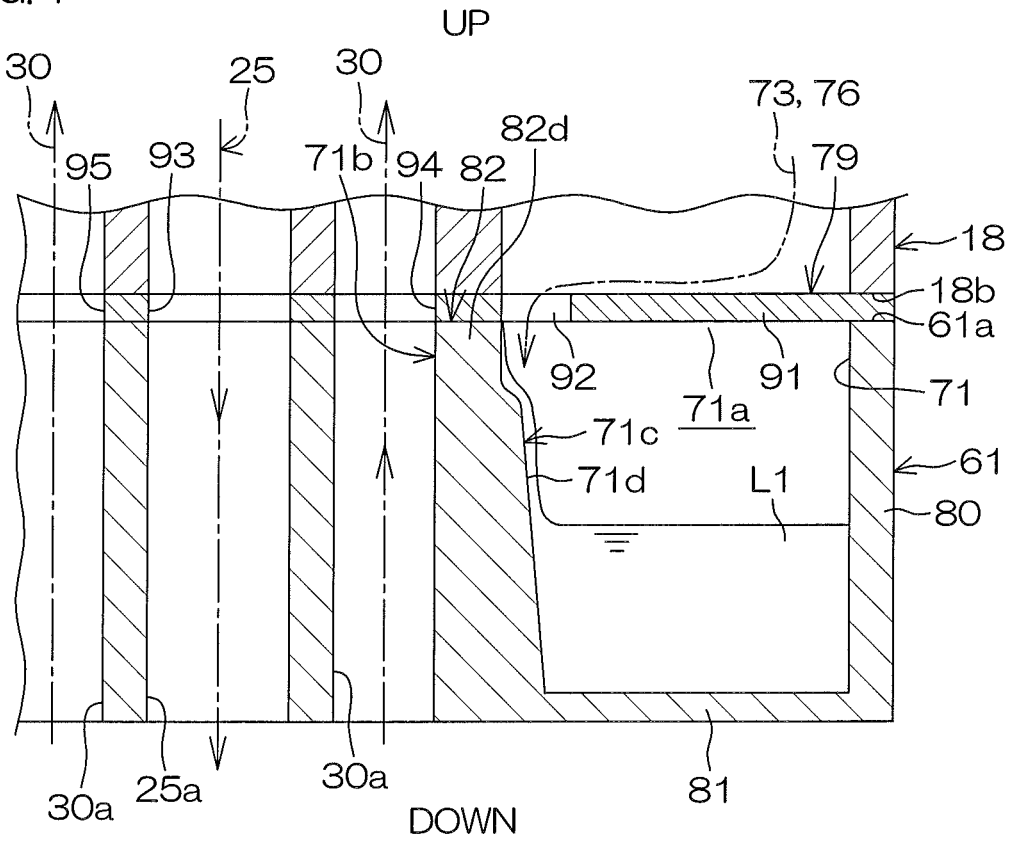
FIG. 7 is a schematic sectional view of an exhaust guide, the oil pan gasket, and the oil pan, and shows a section cut along a vertical plane including line 700 in FIG. 6.

FIG. 6 is a schematic perspective view of the oil pan 61 with the oil pan gasket 79 set thereon. FIG. 7 is a schematic sectional view of the exhaust guide 18, the oil pan gasket 79, and the oil pan 61, and shows a section cut along a vertical plane including line 700 in FIG. 6. The vertical plane corresponds to a plane parallel or substantially parallel to a rotation axis of the steering shaft 8. As shown in FIG. 4, FIG. 6, and FIG. 7, the oil pan gasket 79 includes a shielding portion 91 configured to close-off and disposed in an oil recovery passage so as to be located over the opening 71*a* of the oil pan retaining portion 71, and a guide hole 92 disposed in the oil recovery passage so as to be located over the inner wall surface 71*c* of the oil retaining portion 71. The shielding portion 91 and the guide hole 92 are disposed inside the oil recovery passage (first oil recovery passage 73) configured to recover lubricating oil in at least the crank chamber 44. The oil pan 61 includes a portion 73*a* being a portion of the first oil recovery passage 73 configured to recover lubricating oil from at least the crank chamber 44. The oil recovery passage preferably includes a portion 76*a* being a portion of the third oil recovery passage 76 and a portion being a portion (not shown) of the second oil recovery passage 74, beside the portion 73*a* of the first oil recovery passage 73.

The shielding portion 91 and the guide hole 92 are disposed inside the first oil recovery passage 73, the second oil recovery passage 74, and the third oil recovery passage 76 schematically shown in FIG. 3. However, in FIG. 4, FIG. 6, and FIG. 7, only the first oil recovery passage 73 and the third oil recovery passage 76 are shown. The oil pan gasket 79 constitutes a guide member configured to guide lubricating oil inside the oil recovery passages to the guide hole 92 by the shielding portion 91 and allow lubricating oil to flow down to the inner wall surface 71*c* of the oil retaining portion 71 from the guide hole 92. That is, the guide member includes the oil pan gasket 79 that is provided with the shielding portion 91 and the guide hole 92 and is configured to contact the oil pan 61 between the engine 9 and the oil pan 61. The oil pan gasket 79 defining and serving as a guide member is configured to guide lubricating oil inside the first oil recovery passage 73 and lubricating oil inside the third oil recovery passage 76 to the guide hole 92 by the shielding portion 91, and allow lubricating oil to flow down to the inner wall surface 71*c* of the oil retaining portion 71 from the guide hole 92. More specifically, the guide hole 92 is disposed over the adjacent portion 71*d* that is adjacent to the cooling water supply passage 30 serving as a cooling water passage in the inner wall surface 71*c* of the oil retaining portion 71. As shown in FIG. 7, the inner wall surface 71*c* of the oil retaining portion 71 is covered with a lubricating oil L1 that has passed through the guide hole 92.

As shown in FIG. 4, the oil pan gasket 79 includes a main exhaust hole 93 that communicates with the portion 25*a* of the main exhaust passage 25 inside the oil pan 61, and a plurality of water feed holes 94, 95, and 96 that communicate with the portion 30*a* of the cooling water supply passage 30 inside the oil pan 61 and take in the periphery of the main exhaust hole 93. The main exhaust hole 93 constitutes a portion of the main exhaust passage 25. The water feed holes 94, 95, and 96 constitute a portion of the cooling water supply passage 30.

The oil pan gasket 79 further includes a plurality of idle exhaust holes 97 configured to communicate with the portion 27*a* of the idle exhaust passage 27 inside the oil pan 61, a water feed hole 98 configured to communicate with the portion 67*a* of the cooling water relief passage 67 inside the oil pan 61, and a drain hole 99 configured to communicate with the portion 33*a* of the cooling water discharge passage 33 inside the oil pan 61. The idle exhaust holes 97 constitute a portion of the idle exhaust passage 27. The water feed hole 98 constitutes a portion of the cooling water relief passage 67.

The oil pan gasket 79 further includes a blowby gas vent hole 100 that constitutes a portion of the first blowby gas passage 62 schematically shown in FIG. 2 and FIG. 3, and a plurality of screw insertion holes 101 that respectively communicate with the respective screw insertion holes 87 of the oil pan 61 shown in FIG. 4.

The oil pan gasket 79 further includes screw insertion holes 102 that respectively communicate with the respective screw holes 88 of the oil pan 61, and a steering shaft insertion hole 103 that communicates with the steering shaft insertion hole 90 of the oil pan 61.

Figure 8:
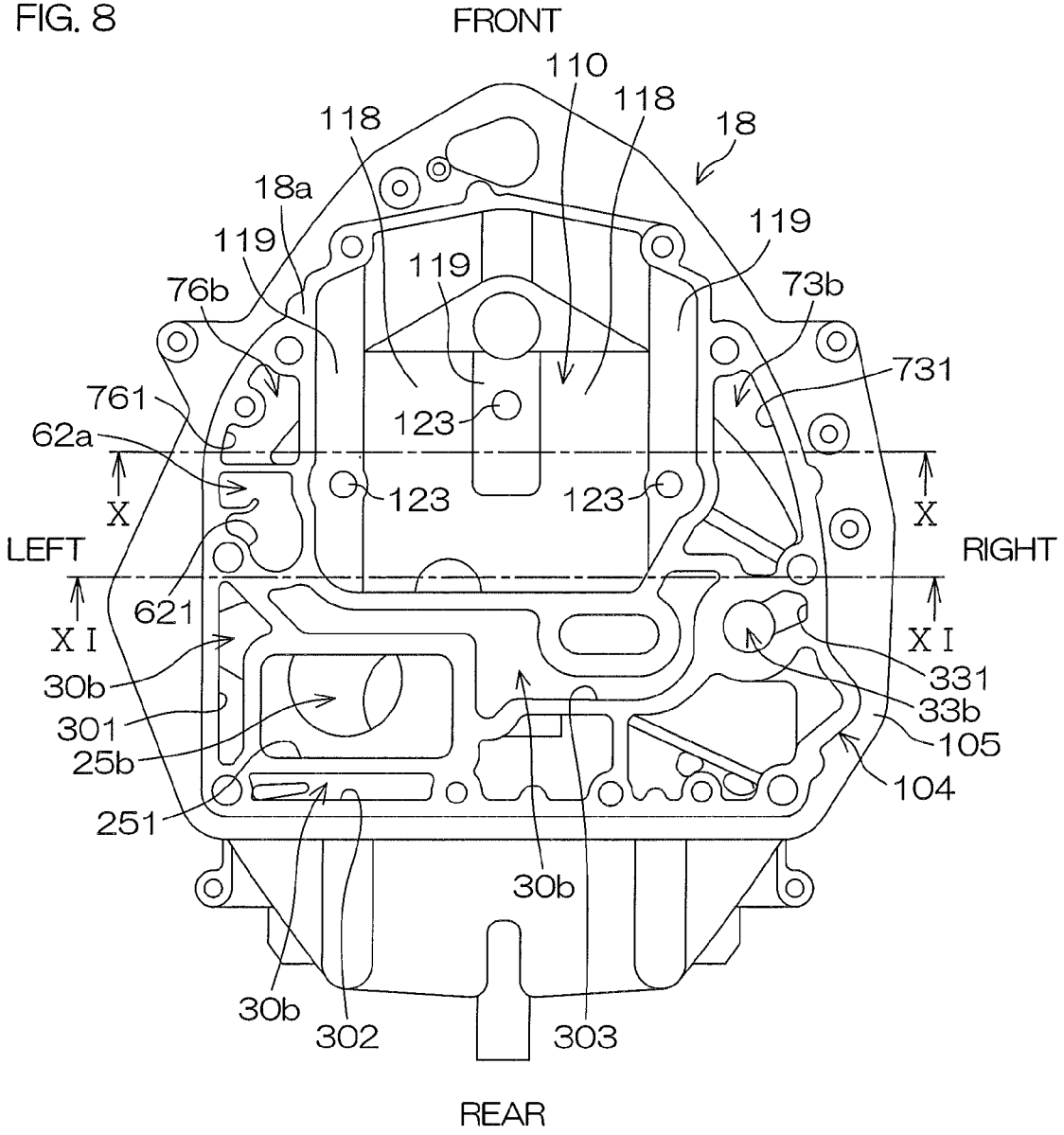
FIG. 8 is a plan view of the exhaust guide.
Figure 9:
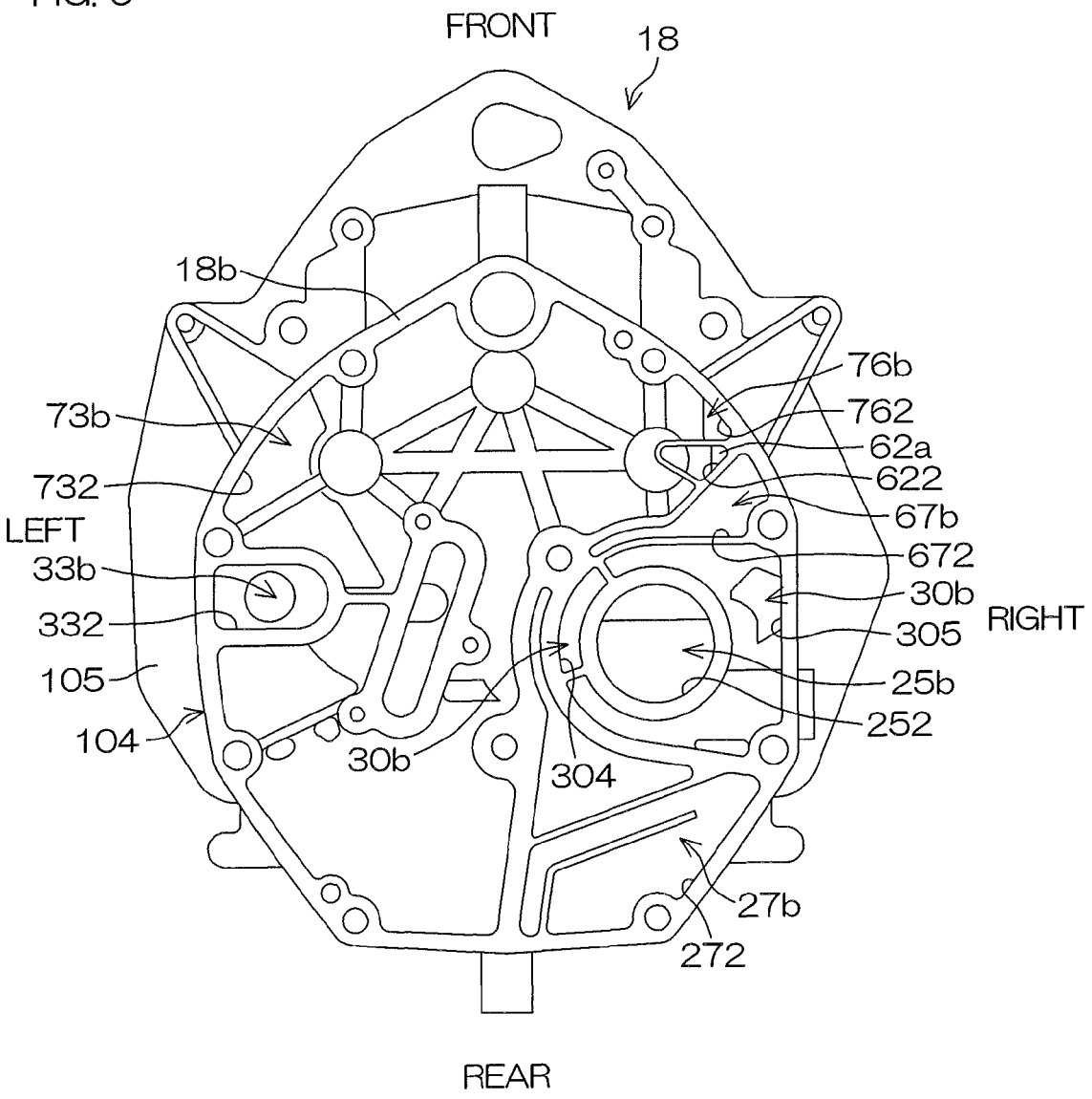
FIG. 9 is a bottom view of the exhaust guide set on the oil pan.
Figure 10:
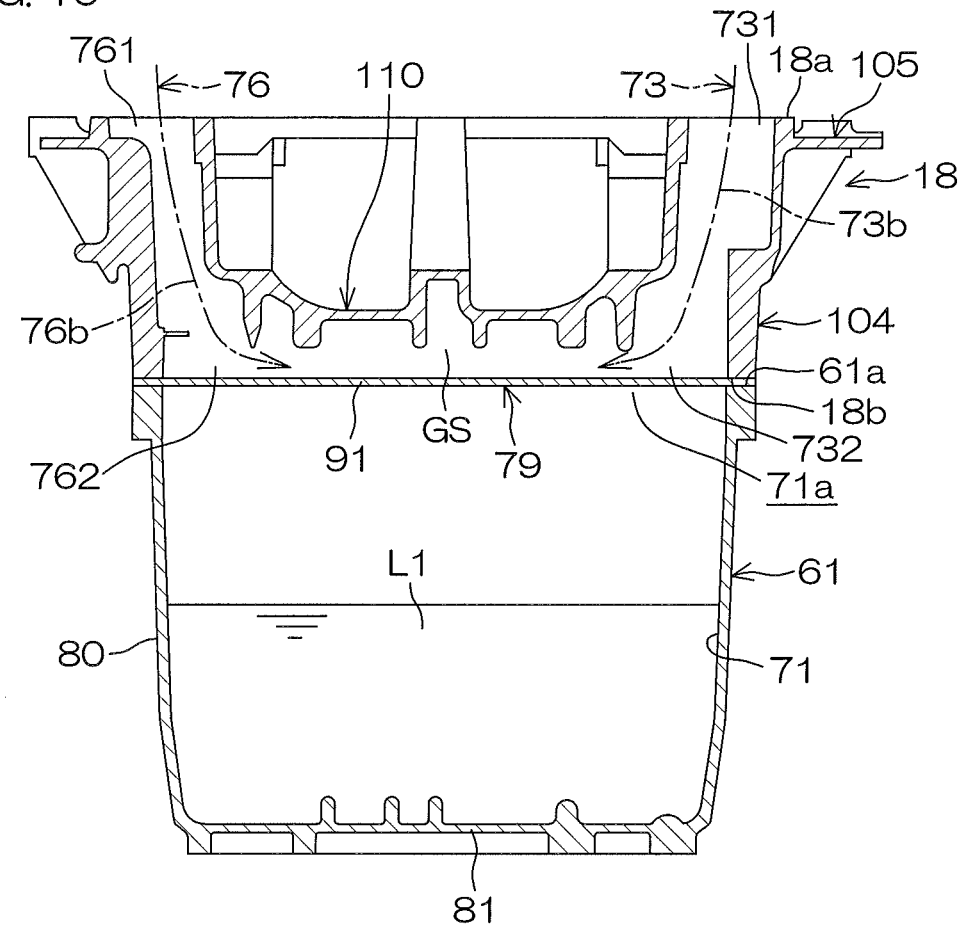
FIG. 10 is a sectional view of the exhaust guide, the oil pan gasket, and the oil pan, and corresponds to a sectional view cut along line X-X in FIG. 8.
Figure 11:
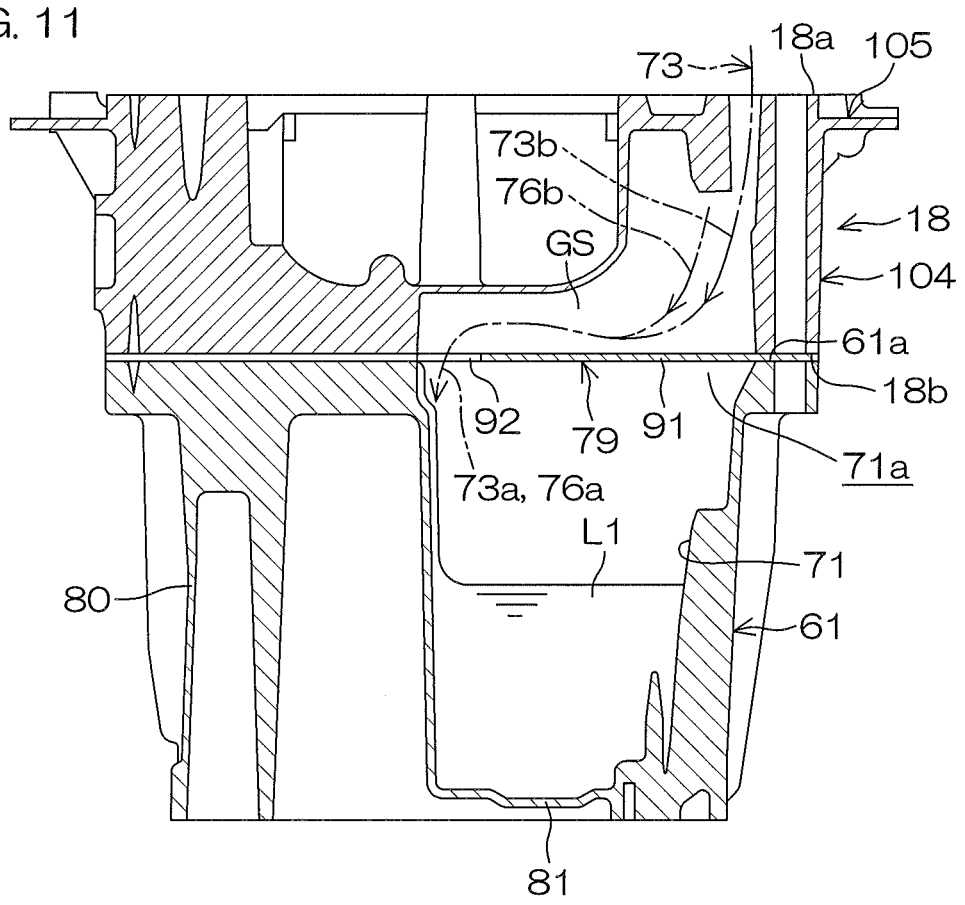
FIG. 11 is a sectional view of the exhaust guide, the oil pan gasket, and the oil pan, and corresponds to a sectional view cut along line XI-XI in FIG. 8.

FIG. 8 is a plan view of the exhaust guide 18 disposed on the oil pan 61 via the oil pan gasket 79. FIG. 9 is a bottom view of the exhaust guide 18. FIG. 10 is a sectional view taken along line X-X in FIG. 8, and FIG. 11 is a sectional view taken along line XI-XI in FIG. 8. As shown in FIG. 8 to FIG. 11, the exhaust guide 18 includes a block-shaped exhaust guide main body 104 and a flange 105 that projects from the exhaust guide main body 104 to the outer lateral side. As shown in FIG. 10 and FIG. 11, the exhaust guide 18 includes an upper end portion 18*a* and a lower end portion 18*b*. The upper end portion 18*a* of the exhaust guide 18 is constituted by an upper end portion of the exhaust guide main body 104. The lower end portion 18*b* of the exhaust guide 18 is constituted by a lower end portion of the exhaust guide main body 104.

As shown in FIG. 3, the upper end portion 18*a* of the exhaust guide 18 abuts against a lower end portion 40*a* of the cylinder body 40 and a lower end portion 43*a* of the crank case 43 via the engine gasket 78. As shown in FIG. 3, FIG. 10, and FIG. 11, the lower end portion 18*b* of the exhaust guide 18 abuts against the upper end portion 61*a* of the oil pan 61 via the oil pan gasket 79. As shown in FIG. 8 and FIG. 9, the exhaust guide 18 includes a portion 73*b* being a portion of the first oil recovery passage 73. The first oil recovery passage 73 is configured to lead lubricating oil from the crank chamber 43 to the inside of the oil retaining portion 71 of the oil pan 61. The portion 73*b* of the first oil recovery passage 73 is defined by a hole that penetrates through the exhaust guide 18 substantially in the up-down direction. The portion 73*b* of the first oil recovery passage 73 includes an opening 731 defined in the upper end portion 18*a* of the exhaust guide 18 as shown in FIG. 8, and an opening 732 defined in the lower end portion 18*b* of the exhaust guide 18 as shown in FIG. 9.

As shown in FIG. 8 and FIG. 9, the exhaust guide 18 further includes a portion 76*b* being a portion of the third oil recovery passage 76. The third oil recovery passage 76 is configured to lead lubricating oil from the oil pressure control valve 77 to the oil retaining portion 71 of the oil pan 61. The portion 76*b* of the third oil recovery passage 76 is defined by a hole that penetrates through the exhaust guide 18 substantially in the up-down direction. The portion 76*b* of the third oil recovery passage 76 includes an opening 761 defined in the upper end portion 18*a* of the exhaust guide 18 as shown in FIG. 8, and an opening 762 defined in the lower end portion 18*b* of the exhaust guide 18 as shown in FIG. 9.

As shown in FIG. 10, over the shielding portion 91 of the oil pan gasket 79, a guide space GS is disposed to guide lubricating oil flowing along the portion 73*b* of the first oil recovery passage 73 and the portion 76*b* of the third oil recovery passage 76 to the guide hole 92. At least a portion of the guide space GS is defined between a portion to define amount support portion 110 of the exhaust guide to be described later and the oil pan gasket 79. The opening 732 in the portion 73*b* of the first oil recovery passage 73 and the opening 762 in the portion 76*b* of the third oil recovery passage 76 are configured to communicate with the guide space GS. The lubricating oil L1 that flows down onto the shielding portion 91 is, as shown in FIG. 11, guided to the guide hole 92 by the shielding portion 91, and flows down to the inside of the oil pan retaining portion 71.

As shown in FIG. 8 and FIG. 9, the exhaust guide 18 further includes a portion 62*a* being a portion of the first blowby gas passage 62. The first blowby gas passage 62 is defined by a hole that penetrates through the exhaust guide 18 substantially in the up-down direction. The portion 62*a* of the first blowby gas passage 62 includes an opening 621 defined in the upper end portion 18*a* of the exhaust guide 18 as shown in FIG. 8, and an opening 622 defined in the lower end portion 18*b* of the exhaust guide 18 as shown in FIG. 9.

As shown in FIG. 8 and FIG. 9, the exhaust guide 18 further includes a portion 25*b* being a portion of the main exhaust passage 25. The portion 25*b* of the main exhaust passage 25 is defined by a hole that penetrates through the exhaust guide 18 substantially in the up-down direction. The portion 25*b* of the main exhaust passage 25 includes an opening 251 defined in the upper end portion 18*a* of the exhaust guide 18 as shown in FIG. 8, and an opening 252 defined in the lower end portion 18*b* of the exhaust guide 18 as shown in FIG. 9.

As shown in FIG. 8 and FIG. 9, the exhaust guide 18 further includes a portion 27*b* being a portion of the idle exhaust passage 27. The idle exhaust passage 27 is defined by a hole that penetrates through the exhaust guide 18 substantially in the up-down direction. The portion 27*b* of the idle exhaust passage 27 includes an opening 271 defined in the upper end portion 18*a* of the exhaust guide 18 as shown in FIG. 8, and an opening 272 defined in the lower end portion 18*b* of the exhaust guide 18 as shown in FIG. 9.

As shown in FIG. 8 and FIG. 9, the exhaust guide 18 further includes a portion 30*b* being a portion of the cooling water supply passage 30. The cooling water supply passage 30 is defined by a hole that penetrates through the exhaust guide 18 substantially in the up-down direction. The portion 30*b* of the cooling water supply passage 30 includes openings 301, 302, and 303 defined in the upper end portion 18*a* of the exhaust guide 18 as shown in FIG. 8, and an opening 304 defined in the lower end portion 18*b* of the exhaust guide 18 as shown in FIG. 9.

As shown in FIG. 8 and FIG. 9, the exhaust guide 18 further includes a portion 33*b* being a portion of the cooling water discharge passage 33. The portion 33*b* of the cooling water discharge passage 33 communicates with the portion 33*a* of the cooling water discharge passage 33 provided in the oil pan 61. The portion 33*b* of the cooling water discharge passage 33 is defined by a hole that penetrates through the exhaust guide 18 substantially in the up-down direction. The portion 33*b* of the cooling water discharge passage 33 includes an opening 331 defined in the upper end portion 18*a* of the exhaust guide 18 as shown in FIG. 8, and an opening 332 defined in the lower end portion 18*b* of the exhaust guide 18 as shown in FIG. 9.

As shown in FIG. 8 and FIG. 9, the exhaust guide 18 further includes a portion 67*b* being a portion of the cooling water relief passage 67. The portion 67*b* of the cooling water relief passage 67 communicates with the portion 67*a* of the cooling water relief passage 67 provided in the oil pan 61. The portion 67*b* of the cooling water relief passage 67 branches from a branch position provided in a halfway portion of the portion 30*b* of the cooling water supply passage 30. The portion 67*b* of the cooling water relief passage 67 includes an opening 672 defined in the lower end portion 18*b* of the exhaust guide 18 as shown in FIG. 9.

Figure 12:
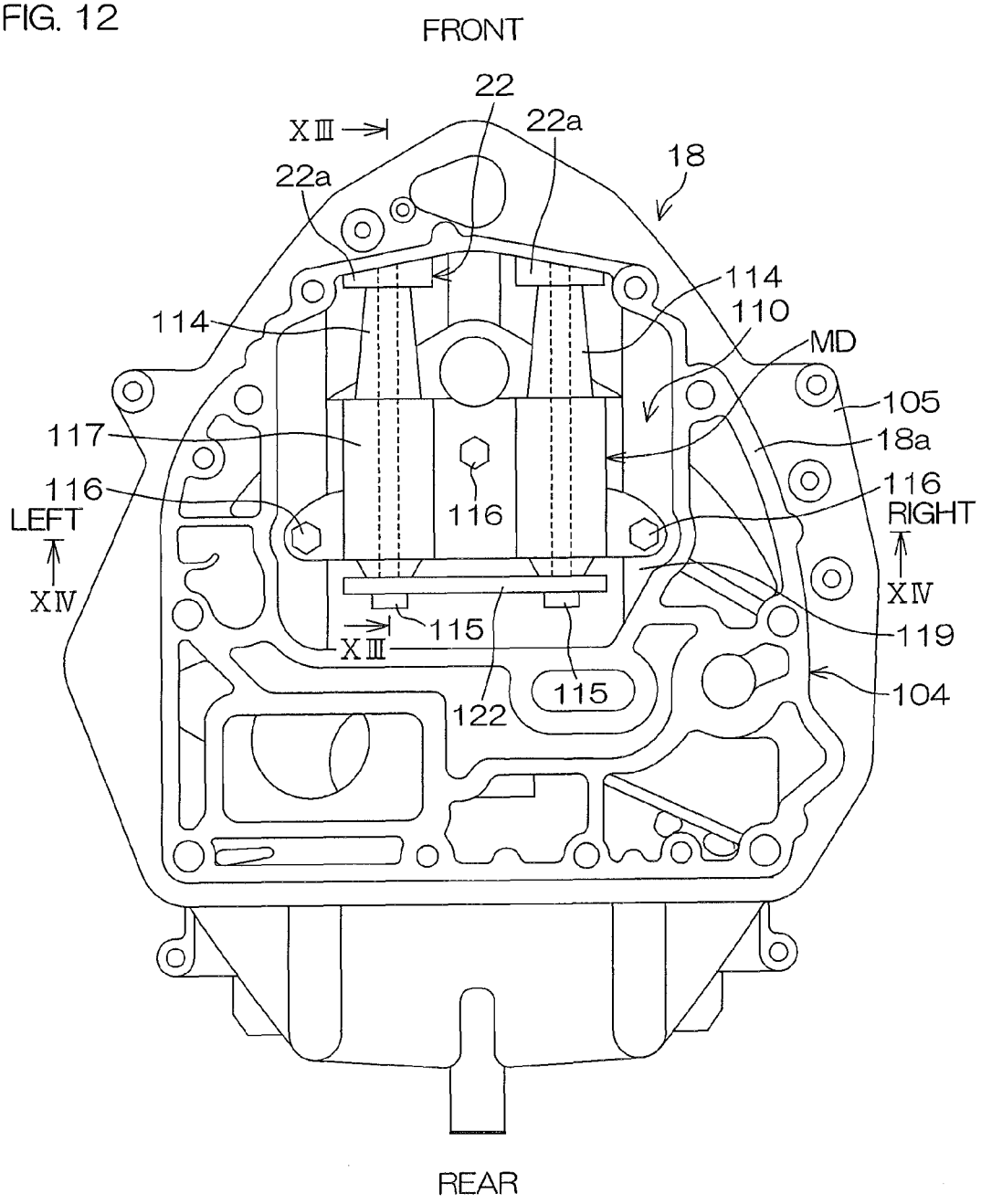
FIG. 12 is a plan view of the exhaust guide mounted with a mount damper.

As shown in FIG. 8, the exhaust guide 18 includes a mount support portion 110 that supports the mount damper MD defining and serving as a mount. As shown in FIG. 12, the mount damper MD defining and serving as a mount coupled to the steering bracket 22 is mounted and supported by the mount support portion 110. As shown in FIG. 12, the rear end of the steering bracket 22 includes a pair of branching portions 22*a* branching in a bifurcated shape toward the rear.

Figure 13:
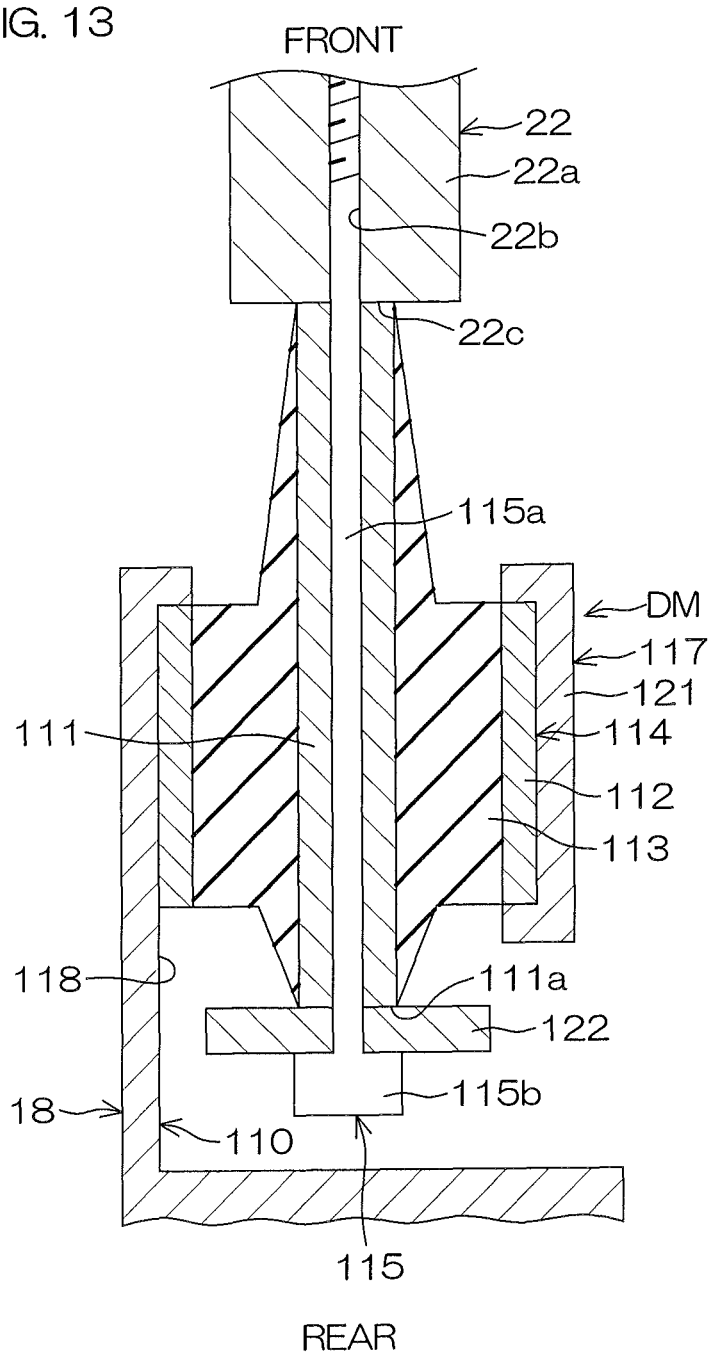
FIG. 13 is a sectional view of the principal portion of the mount damper and a mount support portion of the exhaust guide, and corresponds to a sectional view cut along line XIII-XIII in FIG. 12.
Figure 14:
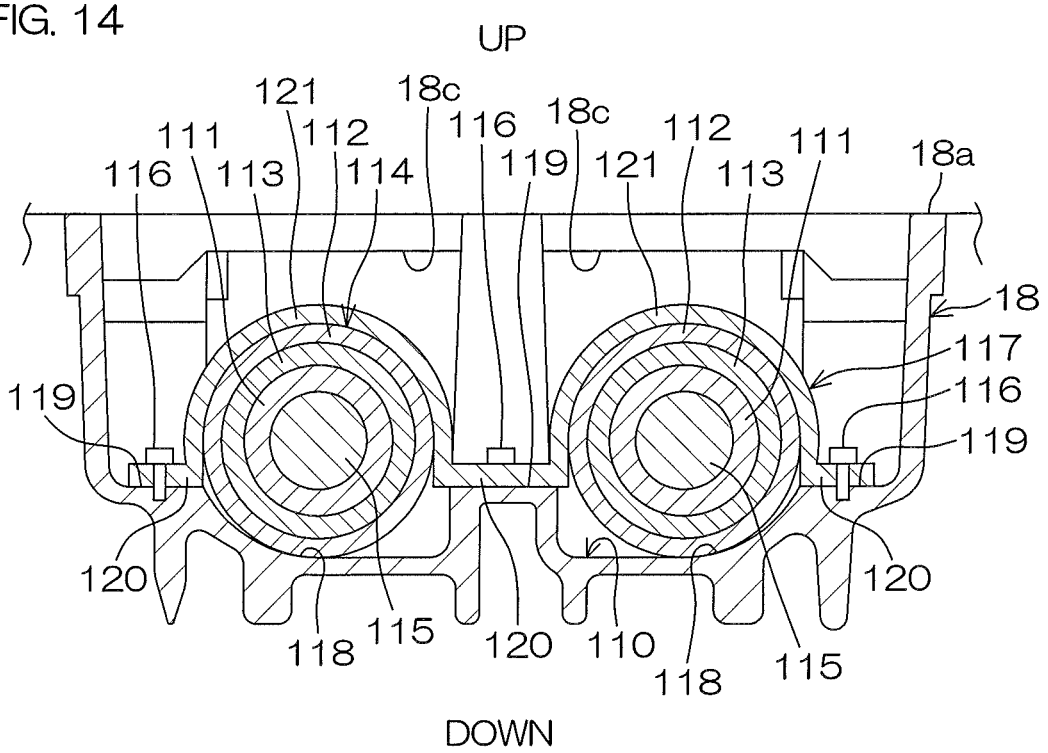
FIG. 14 is a sectional view of the principal portion of the mount damper and a mount support portion of the exhaust guide, and corresponds to a sectional view cut along line XIV-XIV in FIG. 12.

FIG. 13 is a sectional view taken along line XIII-XIII in FIG. 12, and FIG. 14 is a sectional view taken along line XIV-XIV in FIG. 12. FIG. 13 and FIG. 14 show a mounted state of the mount damper MD on the mount support portion 110. As shown in FIG. 13 and FIG. 14, the mount damper MD includes a metallic inner cylinder 111, a metallic outer cylinder 112 surrounding the inner cylinder 111, and an elastic member 113 including, for example, rubber interposed between the inner cylinder 111 and the outer cylinder 112 to couple the inner cylinder 111 and the outer cylinder 112. The inner cylinder 111, the outer cylinder 112, and the elastic member 113 constitute a first mount element 114 including a rubber bushing. The mount damper DM includes a pair of the first mount elements 114.

As shown in FIG. 12 and FIG. 13, the mount damper MD further includes a first fixing screw 115 that fixes the inner cylinder 111 to the steering bracket 22 by being inserted through the inner cylinder 111 of each first mount element 114 and screwed and fixed into a screw hole 22*b* of the steering bracket 22. The first fixing screw 115 includes a screw shaft 115*a* screwed into the screw hole 22*b* of the branching portion 22*a* of the steering bracket 22, and a head portion 115*b* provided at one end of the screw shaft 115*a*. As shown in FIG. 13, a common plate-shaped spacer 122 is interposed between the head portions 115*b* of the pair of first fixing screws 115 and end surfaces 111*a* of the respective inner cylinders 111. Between the spacer 122 and end surfaces 22*c* of the respective branching portions 22*a* of the steering bracket 22, the inner cylinders 111 are axially sandwiched and fixed. As shown in FIG. 12 and FIG. 14, the mount damper MD further includes a second mount element 117 that is screwed to the mount support portion 110 by a plurality of second fixing screws 116 to fix the outer cylinder 112 of each first mount element 114 to the mount support portion 110.

As shown in FIG. 8 and FIG. 14, the mount support portion 110 includes a pair of receiving portions 118 that respectively receive the outer cylinders 112 of corresponding first mount elements 114, and second receiving portions 119 that are disposed on both sides of the pair of first receiving portions 118 in terms of the left-right direction and between the pair of first receiving portions 118 in terms of the left-right direction and receive the second mount element 117. As shown in FIG. 8, the respective second receiving portions 119 include screw holes 123 into which corresponding second fixing screws 116 are screwed. As shown in FIG. 14, the second mount element 117 includes three fastening portions 120 that are fastened using corresponding second fixing screws 116 to corresponding second receiving portions 119 of the mount support portion 110, and curved clamp portions 121 each disposed between the adjacent fastening portions 120 to sandwich a corresponding first mount element 114 with a corresponding first receiving portion 118 of the mount support portion 110.

According to the present first preferred embodiment, the following excellent effects are provided. That is, as shown in FIG. 7, the outboard motor 4 includes a guide member provided with the shielding portion 91 disposed inside an oil recovery passage so as to be located over the opening 71*a* of the oil retaining portion 71 of the oil pan 61 and the guide hole 92 disposed inside the oil recovery passage so as to be located over an inner wall surface of the oil retaining portion 71. Also, the outboard motor 4 includes a cooling water passage disposed along an outer wall surface of the oil retaining portion 71.

Because cooling water thus contacts the outer wall surface 71*b* of the oil retaining portion 71, the inner wall surface 71*c* of the oil retaining portion 71 is efficiently cooled, and maintained at low temperature. Lubricating oil is thus efficiently cooled. Also, lubricating oil that flows down toward the opening 71*a* of the oil retaining portion 71 is blocked by the shielding portion 91, and guided to the guide hole 92. Because the guide hole 92 is located over the inner wall surface 71*c* of the oil retaining portion 71, the lubricating oil L1 that has flowed down from the guide hole 92 flows down along the inner wall surface 71*c* of the oil retaining portion 71. The lubricating oil L1 is thus efficiently cooled by the inner wall surface 71*c* that is low temperature. Further, because the area of a portion exposed from the lubricating oil in the inner wall surface 71*c* of the oil retaining portion 71 decreases, the amount of water to be generated by condensation is significantly reduced. Here, the oil recovery passage includes a first oil recovery passage 73 configured to lead lubricating oil inside at least the crank chamber 44 to the oil retaining portion 71. The oil recovery passage may include at least one of the second oil recovery passage 74 and the third oil recovery passage 76, besides the first oil recovery passage 73. The cooling water passage may include a cooling water supply passage 30.

Also, the inner wall surface 71*c* of the oil retaining portion 71 includes an adjacent portion 71*d* located on the periphery of the cooling water passage (for example, the cooling water supply passage 30), and the guide hole 92 is disposed over the adjacent portion 71*d*. Because lubricating oil that has flowed down from the guide hole 92 thus flows down along the efficiently cooled adjacent portion 71*d*, the lubricating oil is more efficiently cooled.

Also, because the adjacent portion 71*d* of the inner wall surface 71*c* of the oil retaining portion 71 is covered with lubricating oil that has passed through the guide hole 92, the lubricating oil is more efficiently cooled. Because the area of a portion exposed from the lubricating oil in the inner wall surface 71*c* of the oil retaining portion 71 further decreases, the amount of water to be generated by condensation is significantly reduced.

Also, the passage of cooling water that is caused to flow along the outer wall surface 71*b* of the oil retaining portion 71 includes a cooling water supply passage 30 extending to the engine 9 from the water inlet 28 to be disposed in water, and disposed along the outer wall surface 71*b* of the oil retaining portion 71. Because low-temperature cooling water before being used to cool the engine 9 thus flows along the outer wall surface 71*b* of the oil retaining portion 71, the lubricating oil is more efficiently cooled.

Also, the outboard motor 4 includes an exhaust passage extending downward from the engine 9 through the oil pan 61, and at least a portion of the cooling water passage is disposed between the oil retaining portion 71 and the exhaust passage. Low-temperature cooling water before being used to cool the engine 9 can thus cool both the lubricating oil in the oil retaining portion 71 and exhaust in the exhaust passage. Here, the exhaust passage may be a main exhaust passage 25 as in the example of FIG. 7. It suffices that the exhaust passage includes at least one of the main exhaust passage 25 and the idle exhaust passage 27. At least the portion of the cooling water passage that is disposed between the oil retaining portion 71 and the exhaust passage (at least one of the main exhaust passage 25 and the idle exhaust passage 27) may include a portion 30*a* of the cooling water supply passage 30. At least the portion of the cooling water passage that is disposed between the oil retaining portion 71 and the exhaust passage (at least one of the main exhaust passage 25 and the idle exhaust passage 27) may further include a cooling water relief passage 67.

Also, the guide member includes an oil pan gasket 79 that is provided with the shielding portion 91 and the guide hole 92, and contacts the oil pan 61 between the engine 9 and the oil pan 61. Thus, a simple design modification of the oil pan gasket 79 easily realizes a function as a guide member that guides lubricating oil inside the oil recovery passage so as to allow lubricating oil to flow down to the inner wall surface 71*c* of the oil retaining portion 71.

Also, the outboard motor 4 includes a blowby gas passage (corresponding to the first blowby gas passage 62) separate from the oil recovery passage (corresponding to the first oil recovery passage 73), extending downward from the crank chamber 44 to the oil retaining portion 71, to lead a blowby gas inside the crank chamber 44 to the inside of the oil retaining portion 71. Thus, disruption of the flow of lubricating oil inside the oil recovery passage by a blowby gas the flow direction of which inside the crank chamber 44 tends not to be fixed in one direction due to the effect of the motion of the piston 37 of the engine 9 is significantly reduced or prevented.

Also, the outboard motor 4 includes an exhaust passage extending downward from the engine 9 through the oil pan 61, and at least a portion of the cooling water passage is disposed between the oil retaining portion 71 and the exhaust passage. Low-temperature cooling water before being used to cool the engine 9 can thus cool both the lubricating oil in the oil retaining portion 71 and exhaust in the exhaust passage. Here, at least the portion of the cooling water passage may include a portion 30*a* being a portion of the cooling water supply passage 30. It suffices that the exhaust passage includes at least one of the portion 25*a* of the main exhaust passage 25 and the idle exhaust passage 27*a*.

Also, the outboard motor 4 includes an exhaust guide 18 provided with a portion of the oil recovery passage, blowby gas passage, and exhaust passage, and disposed between the engine 9 and the oil pan 62. Thus, simplification and downsizing of the structure is achieved by increasing functions served by the exhaust guide 18. Here, it suffices that the oil recovery passage includes at least the first oil recovery passage 73 among the first oil recovery passage 73, the second oil recovery passage 74, and the third oil recovery passage 76. It suffices that the exhaust passage includes at least one of the main exhaust passage 25 and the idle exhaust passage 27. It suffices that the blowby gas passage includes at least one of the first blowby gas passage 62 and the second blowby gas passage 63.

Also, the exhaust guide 18 includes amount support portion 110 on which a mount damper DM to be interposed between the hull H1 and the outboard motor 4 is disposed. When the exhaust guide 18 with a mount damper DM disposed is disposed between the engine 9 and the oil pan 61, it becomes less easy to flow lubricating oil from the engine 9 to the oil pan 61. As a result, lubricating oil inside the oil pan 61 tends to become a high temperature. In contrast thereto, in the present first preferred embodiment, sufficient cooling performance is obtained by enhancing the cooling effect of lubricating oil inside the oil pan 61 by using the guide member.

Although the oil pan gasket 79 preferably constitutes a guide member, in the first preferred embodiment, the present invention is not limited to this arrangement, and for example, the guide member may include an engine gasket that is disposed between the engine and oil pan, an exhaust guide that is disposed between the engine gasket and oil pan, and an oil pan gasket, and the shielding portion and guide hole may be provided in any of the engine gasket, exhaust guide, and oil pan gasket. In this case, the degree of freedom of design is increased.

Figure 15:
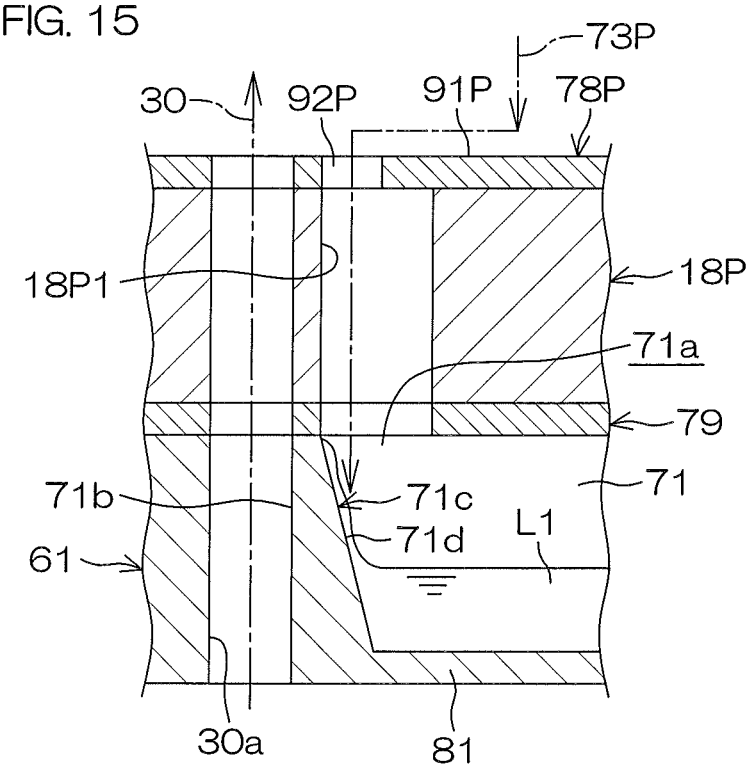
FIG. 15 is a schematic sectional view of the principal portion of an engine gasket, an exhaust guide, an oil pan gasket, and an oil pan in a second preferred embodiment of the present invention.

For example, as shown in a second preferred embodiment of FIG. 15, the engine gasket 78P preferably is provided with a shielding portion 91P disposed inside an oil recovery passage 73P so as to be located over an opening 71*a* of an oil retaining portion 71 and a guide hole 92P disposed inside the oil recovery passage 73P so as to be located over an inner wall surface 71*c* of the oil retaining portion 71. The engine gasket 78P constitutes a guide member that guides lubricating oil inside the oil recovery passage 73P to the guide hole 92P by the shielding portion 91P and allows lubricating oil to flow down to the inner wall surface 71*c* of the oil retaining portion 71 from the guide hole 92P. The lubricating oil from the guide hole 92P flows down to the inner wall surface 71*c* of the oil retaining portion 71 through a passage 18P1 provided in an exhaust guide 18P under the guide hole 92P and over the inner wall surface 71*c* of the oil retaining portion 71. Of the components of the second preferred embodiment shown in FIG. 15, components that are the same as the components of the first preferred embodiment shown in FIG. 7 are designated by the same reference signs as the reference signs of the components of the first preferred embodiment shown in FIG. 7.

Figure 16:
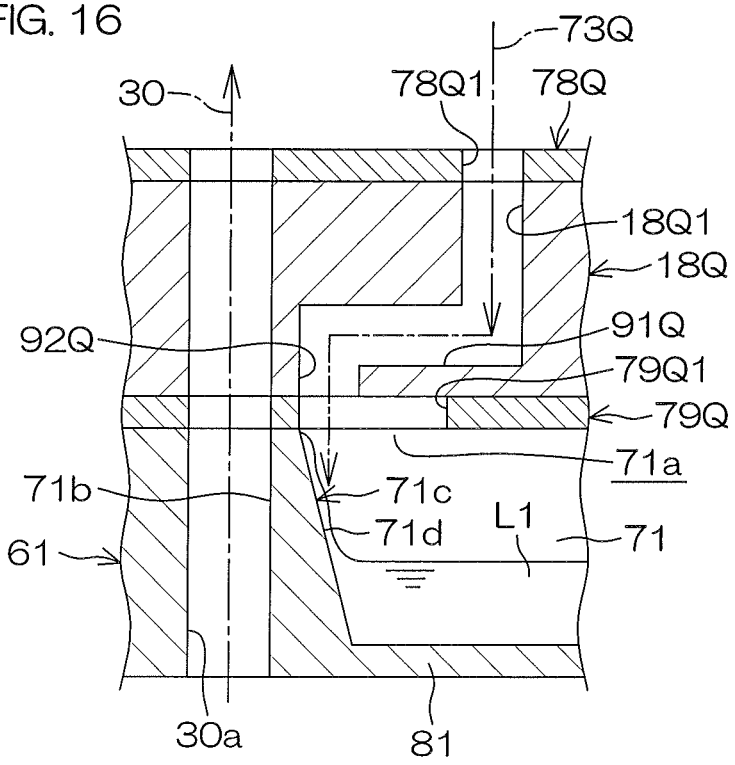
FIG. 16 is a schematic sectional view of the principal portion of an engine gasket, an exhaust guide, an oil pan gasket, and an oil pan in a third preferred embodiment of the present invention.

Also, as shown in a third preferred embodiment of FIG. 16, the exhaust guide 18Q preferably is provided with a shielding portion 91Q disposed inside an oil recovery passage 73Q so as to be located over an opening 71*a* of an oil retaining portion 71 and a guide hole 92Q disposed inside the oil recovery passage 73Q so as to be located over an inner wall surface 71*c* of the oil retaining portion 71. The shielding portion 91Q is disposed over an opening 79Q1 of an oil pan gasket 79Q. The exhaust guide 18Q constitutes a guide member that guides lubricating oil inside the oil recovery passage 73Q to the guide hole 92Q by the shielding portion 91Q and allows lubricating oil to flow down to the inner wall surface 71*c* of the oil retaining portion 71 from the guide hole 92Q. Lubricating oil from the crank chamber flows down onto the shielding portion 91Q through a passage 78Q1 provided in an engine gasket 78Q and a passage 18Q1 provided in the exhaust guide 18Q, and guided to the guide hole 92Q. Of the components of the third preferred embodiment shown in FIG. 16, components that are the same as the components of the first preferred embodiment shown in FIG. 7 are designated by the same reference signs as the reference signs of the components of the first preferred embodiment shown in FIG. 7.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The present application corresponds to Japanese Patent Application No. 2013-232396 filed in the Japanese Patent Office on Nov. 8, 2013, and the entire disclosure of this application is incorporated herein by reference.

What is claimed is:

1. An outboard motor comprising:

an engine including a crankshaft configured to be rotatable about a rotation axis extending in an up-down direction, and a crank chamber that houses the crankshaft;

an oil pan that includes an oil retaining portion provided at an upper end portion thereof with an opening opened upward, and that is disposed under the engine and configured to retain lubricating oil to be supplied to at least the crank chamber inside the oil retaining portion;

a cooling water passage disposed along an outer wall surface of the oil retaining portion;

an oil recovery passage that extends downward from the crank chamber to the oil retaining portion and is configured to lead lubricating oil inside the crank chamber to an inside of the oil retaining portion; and a guide member that is provided with a shielding portion disposed inside the oil recovery passage so as to be located over the opening of the oil retaining portion and a guide hole disposed inside the oil recovery passage so as to be located over an inner wall surface of the oil retaining portion, and that is configured to guide lubricating oil inside the oil recovery passage to the guide hole by the shielding portion and allow lubricating oil to flow down to the inner wall surface of the oil retaining portion from the guide hole.

2. The outboard motor according to claim 1, wherein the inner wall surface of the oil retaining portion includes an adjacent portion located on a periphery of the cooling water passage; and the guide hole is disposed over the adjacent portion.

3. The outboard motor according to claim 2, wherein the adjacent portion of the oil retaining portion is covered with lubricating oil that has passed through the guide hole.

4. The outboard motor according to claim 1, wherein the cooling water passage includes a cooling water supply passage extending to the engine from a water inlet to be disposed in water and disposed along the outer wall surface of the oil retaining portion.

5. The outboard motor according to claim 1, further comprising an exhaust passage extending downward from the engine through the oil pan, wherein at least a portion of the cooling water passage is disposed between the oil retaining portion and the exhaust passage.

6. The outboard motor according to claim 1, wherein the guide member includes an oil pan gasket that is provided with the shielding portion and the guide hole and is configured to contact the oil pan between the engine and the oil pan.

7. The outboard motor according to claim 1, further comprising a blowby gas passage that is separated from the oil recovery passage and extends downward from the crank chamber to the oil retaining portion, and is configured to lead a blowby gas inside the crank chamber to an inside of the oil retaining portion.

8. The outboard motor according to claim 7, further comprising:

an exhaust passage extending downward from the engine through the oil pan; and an exhaust guide provided with a portion of the oil recovery passage, the blowby gas passage, and the exhaust passage, disposed between the engine and the oil pan.

9. The outboard motor according to claim 7, wherein the exhaust guide includes a mount support portion on which a mount damper to be interposed between a hull and the outboard motor is disposed.

10. The outboard motor according to claim 1, wherein the guide member includes an engine gasket disposed between the engine and the oil pan, an exhaust guide disposed between the engine gasket and the oil pan, and an oil pan gasket disposed between the exhaust guide and the oil pan; and the shielding portion and the guide hole are provided in any of the engine gasket, the exhaust guide, and the oil pan gasket.

* * * * *